US007237671B2

(12) United States Patent
Chambers et al.

(10) Patent No.: US 7,237,671 B2
(45) Date of Patent: Jul. 3, 2007

(54) MULTIPLE PACKAGED GOOD ARTICLE PACKAGE

(75) Inventors: Prima S. Chambers, Minnetonka, MN (US); Chris Reed, Cottage Grove, MN (US)

(73) Assignee: General Mills, Inc., Minneapolis, MN (US)

( * ) Notice: Subject to any disclaimer, the term of this patent is extended or adjusted under 35 U.S.C. 154(b) by 325 days.

(21) Appl. No.: 10/663,508

(22) Filed: Sep. 16, 2003

(65) Prior Publication Data

US 2005/0086910 A1 Apr. 28, 2005

(51) Int. Cl.
*B65D 76/00* (2006.01)

(52) U.S. Cl. ..... 206/150; 206/429

(58) Field of Classification Search ..... 206/146, 206/150, 155, 162, 167, 428, 429, 430, 431, 206/459.5, 147, 170, 174, 175, 207
See application file for complete search history.

(56) References Cited

U.S. PATENT DOCUMENTS

| | | | | | |
|---|---|---|---|---|---|
| 2,361,926 | A | | 11/1944 | Brodgden | |
| 3,094,210 | A | * | 6/1963 | Den Berg | 206/153 |
| 3,114,496 | A | | 12/1963 | Wilcox | |
| 3,700,275 | A | | 10/1972 | Deasy | |
| 3,923,155 | A | | 12/1975 | Tanzer | |
| D297,916 | S | * | 10/1988 | Gloyer | D6/369 |
| 4,827,114 | A | * | 5/1989 | Blachon | 235/487 |
| 4,930,633 | A | | 6/1990 | Glöyer | |
| 4,936,143 | A | | 6/1990 | Schutten et al. | |
| 5,131,540 | A | * | 7/1992 | Torterotot | 206/427 |
| 5,177,368 | A | * | 1/1993 | Kay | 250/566 |
| 5,279,841 | A | * | 1/1994 | Yu | 426/131 |
| 5,425,446 | A | | 6/1995 | Weaver et al. | |
| 5,452,794 | A | | 9/1995 | DiVietro | |
| 5,501,335 | A | * | 3/1996 | Harris | 206/427 |
| 5,538,130 | A | | 7/1996 | Harrelson | |
| 5,570,787 | A | | 11/1996 | Danovaro et al. | |
| 5,607,056 | A | * | 3/1997 | Whiteside | 206/427 |
| 5,682,983 | A | * | 11/1997 | Weaver et al. | 206/150 |
| 5,938,011 | A | | 8/1999 | Holzapfel et al. | |
| 6,032,791 | A | | 3/2000 | Gresh, Jr. et al. | |
| 6,041,572 | A | * | 3/2000 | Gandini | 53/399 |
| 6,050,399 | A | * | 4/2000 | Pratt | 206/158 |
| 6,409,385 | B1 | | 6/2002 | Gee | |
| 6,880,313 | B1 | * | 4/2005 | Gessford et al. | 53/442 |

* cited by examiner

*Primary Examiner*—Shian T. Luong
(74) *Attorney, Agent, or Firm*—John A. O'Toole; Douglas J. Taylor; Timothy A. Czaja

(57) ABSTRACT

A multiple packaged good article package including a carrier, a multiplicity of packaged good articles, a handle, and retaining means. The carrier includes a base panel and first and second side panels. The packaged good articles each include a bag that defines opposing major faces, a top region, and a bottom region, and are arranged on the carrier in an upright, major face-to-major face fashion with the bottom regions resting on the base panel. Each of a first and second outermost package provides an exposed major face relative to a remainder thereof. The first and second side panels extend along a portion of the respective exposed major faces. The handle is provided apart from the carrier and extends across the top regions of the packaged good articles. Finally, the retaining means secures an interior packaged good article to the outermost packaged good articles.

65 Claims, 13 Drawing Sheets

MULTIPLE PACKAGED GOOD ARTICLE PACKAGE

BACKGROUND

The present invention relates to product packaging. More particularly, it relates to presenting a multiplicity of individual packaged good articles as a unitary package including a handle for convenient transport.

A wide variety of goods, such as consumable goods, are sold to consumers in packaged form on a mass-production basis. Exemplary conventional packaged formats include flexible or rigid bags or pouches (e.g., plastic film; metallized, flexible laminate; or foil-based), boxes, canisters, bottles (e.g., glass or plastic), etc. For particular applications, the packaging is selected in accordance with the product being contained and/or consumer preferences. For example, liquid beverages are commonly packaged in cans or bottles, whereas solid, edible food products (e.g., snack foods, ready-to-eat cereals, etc.) are typically packaged in flexible bags and/or boxes. Regardless, the size of the package is normally selected pursuant to consumer preferences, and relates to desired serving sizes. For example, many products are sold to consumers in approximately single serving size packages (e.g., beverages in 12-ounce cans, yogurt in 2.25-ounce tubes or 6-ounce cups, snack foods in 3.75-ounce bags, etc.). Other packaging schemes provide multiple servings in a format desired by consumers (e.g., milk in one-gallon containers, ready-to-eat cereal in 24-ounce bag-in-a-box, snack foods in 12.25-ounce bags, etc.).

Often times, consumers wish to purchase more than one single-serving sized package good article for subsequent consumption. To meet this demand, manufacturers commonly group a number of individually packaged products into a separate package for subsequent sale. For example, eight 2.25-ounce tubes of Yoplait® Go-Gurt® yogurt are packaged in a single box; six or more individually packaged granola bars are packaged and sold in a single box; etc. Another common example of multiple, individually packaged items grouped together for subsequent sale is canned or bottled beverages. One common format for this type of packaging is to simply package the individual cans or bottles within a paperboard box. Alternatively, plastic rings or other carriers are employed to interconnect the canned or bottle products as a single unit. Once again, the group packaging technique is specific to the size and/or weight of the individual packaged goods.

While quite viable for smaller and/or rigidly packaged items (e.g., bottles), the above-described packaging techniques are ill suited for packaging a multiplicity of larger or jumbo-sized packaged good articles (hereinafter referred to as "multi-pack package"). To this end, bulk sale of packaged goods to consumers has become increasingly popular due to cost savings. Of course, a "bulk"purchase can be facilitated by directing the consumer to manually place two or more of the products, especially those larger sized versions, in the consumer's shopping cart via a promotional description placed in close proximity to the product. However, consumers and retailers strongly prefer that the multiple items be secured to one another for ease of transport and storage.

With the above in mind, bulk packaging of relatively large products requires, in most basic terms, two or more existing (individually manufactured) or discrete packaged good articles packaged or otherwise bound together and then sold as a single bulk item. Beyond connecting the individual packaged good items to one another, the multi-pack package desirably facilitates convenient handling by the consumer. For relatively small packaged items, the employed unitary packaging technique is likewise relatively small and thus inherently easy to handle (e.g., multiplicity of fruit snack pouches packaged within a single box). For larger items, however, accepted package formats fail to satisfy these demands.

For example, paper towel rolls are commonly packaged in a transparent protective film outer packaging layer and sold as individual units. Further, bulk packaging (i.e., multi-pack package) of these individual paper towel rolls is also available whereby a number of independently packaged paper towel rolls (e.g., four, six, twelve, etc.) are grouped within a larger, outer packaging (e.g., shrink-wrap plastic film). This bulk packaging technique can be employed because the contained products (i.e., paper towel rolls) will not be irrevocably damaged when subjected to, and maintained within, a shrink-wrap package. The resulting multi-product package is quite large and bulky, and does not provide a readily identifiable handle or other means for conveniently transporting the package.

In addition to the bulky appearance and handling concerns described above, bulk packaging of many other packaged items must address potential product damage issues. For example, multi-serving packages for snack food items (e.g., pretzels, potato chips, Bugles®, etc.), typically entail a thin-walled plastic or metallized, flexible laminate bag. Were these packaged goods subjected to a shrink-wrap operation as part of a bulk packaging approach, food products contained within the bags would likely be crushed or otherwise damaged.

Other attempts to bulk package a multiplicity of relatively large, individual packages of bagged, potentially crushable snack food products have been relatively simplistic. Namely, two or more (typically three) of the individual product bags are loosely maintained within a sufficiently large outer bag (typically formed of polypropylene film) that is subsequently closed. With some applications, a top of the outer bag forms an opening through which a consumer can insert his/her hand for transporting the bulk package. While viable, this technique presents certain potential drawbacks. For example, the individual packaged product bags are somewhat loose within the outer bag, such that a relatively uniform shape of the overall package cannot be achieved. Instead, each bulk package will likely assume a different overall shape, resulting in wasted shelf space when multiple ones of the bulk packages are placed side-by-side. In addition, the outer bag bulk packaging has a "bulky" appearance, possibly leading to a consumer impression that the multi-pack product is over packaged. Consumers may be less likely to purchase such a product due to concerns that this perceived "over packaging" results in higher costs and/or is not environmentally friendly. Alternatively, multiple, large bags of crushable products can be packaged in a large box. While addressing the shelf storage space concerns described above, the outer box entails relatively significant costs due to the expense of paperboard required to form the box.

Though not a multi-pack package, Sun-Maid® raisins are available in a "twin pack" format by which two, tightly packed 2.25-pound packages (formed foil pouches) are connected at their respective sides by a strip of tape, as well as a short handle extending across the respective tops. This twin pack packaging does not include a separate bottom support element, instead relying upon gussets formed at the bottom of each package for overall, upright stability. Unfortunately, this packaging technique is unworkable with three or more individual packages (i.e., a multi-pack package) as the individual to pouch/package bottoms are not separately supported, such that any intermediate packages (i.e., any package not otherwise connected to the short handle) may simply fall away from the remaining packages upon lifting of the handle. In addition, the Sun-Maid® raisin twin pack technique relies significantly upon an inherent stability of the individual packages (due to the tight, dense nature of the raisins within the foil pouch and gussets formed on the bottom thereof) for overall stability. Many other packaged good articles are not inherently self-standing.

Another concern not addressed by the Sun-Maid® raisin twin pack and other multi-pack packages relates to use of existing packaged good articles. It is highly desirable from the manufacturer's standpoint to use existing packaged good articles as part of a "new" multi-pack package so that new individual package formats (and thus new packaging equipment) are not required. In many instances, the individual packaged good articles otherwise included within the multi-pack package would be sold by the same retailer along with the multi-pack package. In this regard, most product packaging includes a bar code symbol (e.g., UPC code) displayed on an outer surface thereof. The retailer utilizes this bar code as part of its computerized customer purchasing system whereby a database is established that correlates a certain price with numbers or other identifiers (in machine-readable form) provided by a corresponding bar code. Thus, where a particular packaged good item is offered by a retailer to consumers as both a single item and as part of a bulk- or multi-pack package, different bar codes must be assigned. In other words, the bar code associated with a single packaged good item (that is otherwise offered for sale on an individual basis) cannot be used with the multi-pack package. For example, the Sun-Maid® twin pack incorporates two "existing" packages of Sun-Maid® raisins, each having an identical bar code. Thus, when provided as part of a twin pack, the bar codes associated with the individual packages must be covered with a separate component (such as opaque tape) and a "new" bar code must be applied to at least one of the twin pack packages. Clearly, this entails additional material and labor costs, and raises the possibility that the bar code cover component will be unintentionally or intentionally removed. Under these circumstances, it is possible that the single product package bar code will be "scanned" and the corresponding price for the individual product be incorrectly charged for the twin pack product unit, resulting in a monetary loss to the retailer.

Consumer demand for multi-pack or bulk packaged good articles, especially larger packaged good articles, continues to rise. Unfortunately, current packaging techniques do not satisfy consumer, retailer, and manufacturer's needs. As such, a need exists for a multiple packaged good article packaging that is easy to handle, is structurally sound, and does not appear over packaged.

SUMMARY OF THE INVENTION

One aspect of the present invention relates to a multiple packaged good article package including a carrier, a multiplicity of packaged good articles, a handle, and retaining means. The carrier includes a base panel and first and second side panels extending from opposite sides of the base panel. The multiplicity of packaged good articles each include a flexible or semi-rigid walled bag that defines opposing major faces, a top region, and a bottom region. In this regard, the multiplicity of packaged good articles are arranged on the carrier in an upright, major face-to-major face fashion so as to define first and second outermost packaged good articles, and at least one interior packaged good article intermediate the first and second. With this configuration, each of the first and second outermost packages provides an exposed major face relative to a remainder thereof. With this orientation in mind, each of the bottom regions of the multiplicity of packaged good articles contacts the base panel. Further, the first and second side panels of the carrier extend along a portion of the respective exposed major faces. The handle is provided apart from the carrier and extends across the top regions of the packaged good articles. More particularly, the handle extends from the exposed major face of the first outermost package good article(s) to the exposed major face of the second outermost packaged good article. Finally, the retaining means secures the interior packaged good article to the outermost packaged good articles. With this configuration, the carrier, handle, and retaining means provide structural stability to the arranged multiplicity of packaged good articles, with the handle providing a convenient device for transporting the packaging. In one preferred embodiment, the bag associated with each of the packaged good articles is formed of a metallized, flexible laminate material.

Another aspect of the present invention relates to a multiple packaged good article package including a multiplicity of packaged good articles, a carrier, a handle, and retaining means. The multiplicity of packaged good articles are arranged in a major face-to-major face fashion to form a product array. In this regard, the product array defines a top, a bottom, a front, a back, and opposing sides. The carrier includes a base panel and first and second side panels extending from opposite sides thereof. In this regard, the bottom of the product array is positioned on the base panel. The first side panel extends along a portion of the front of the product array. The second side panel extends along a portion of the back of the product array. The handle is provided apart from the carrier and extends across the top of the product array. More particularly, the handle extends from the front of the product array to the back of the product array. The retaining means secures a first one of the packaged good articles to an adjacent, second one of the packaged good articles. In one embodiment, the retaining means includes a hand-force tearable tape strip extending from the first side panel to the second side panel adhesively contacting, and thus interconnecting, the packaged good articles.

Yet another aspect of the present invention relates to a method of assembling a multiple packaged good article package. The method includes providing a carrier including a base panel and first and second side panels extending from opposite sides of the base panel. A multiplicity of packaged good articles are arranged in a major face-to-major face fashion to form a product array. The product array generally defines a top, a bottom, a front, a back, and opposing sides. The bottom of the product array is placed on the base panel. The first side panel is positioned to extend along a portion of the front of the product array, and the second side panel is positioned to extend along a portion of the back of the product array. Adjacent ones of the packaged good articles are secured to one another. Finally, a separate handle component is extended from the front of the product array to the back of the product array, across the top thereof. The resulting multiple packaged good article package is highly stable and does not have an over packaged appearance.

DETAILED DESCRIPTION OF THE INVENTION

Figure 1:
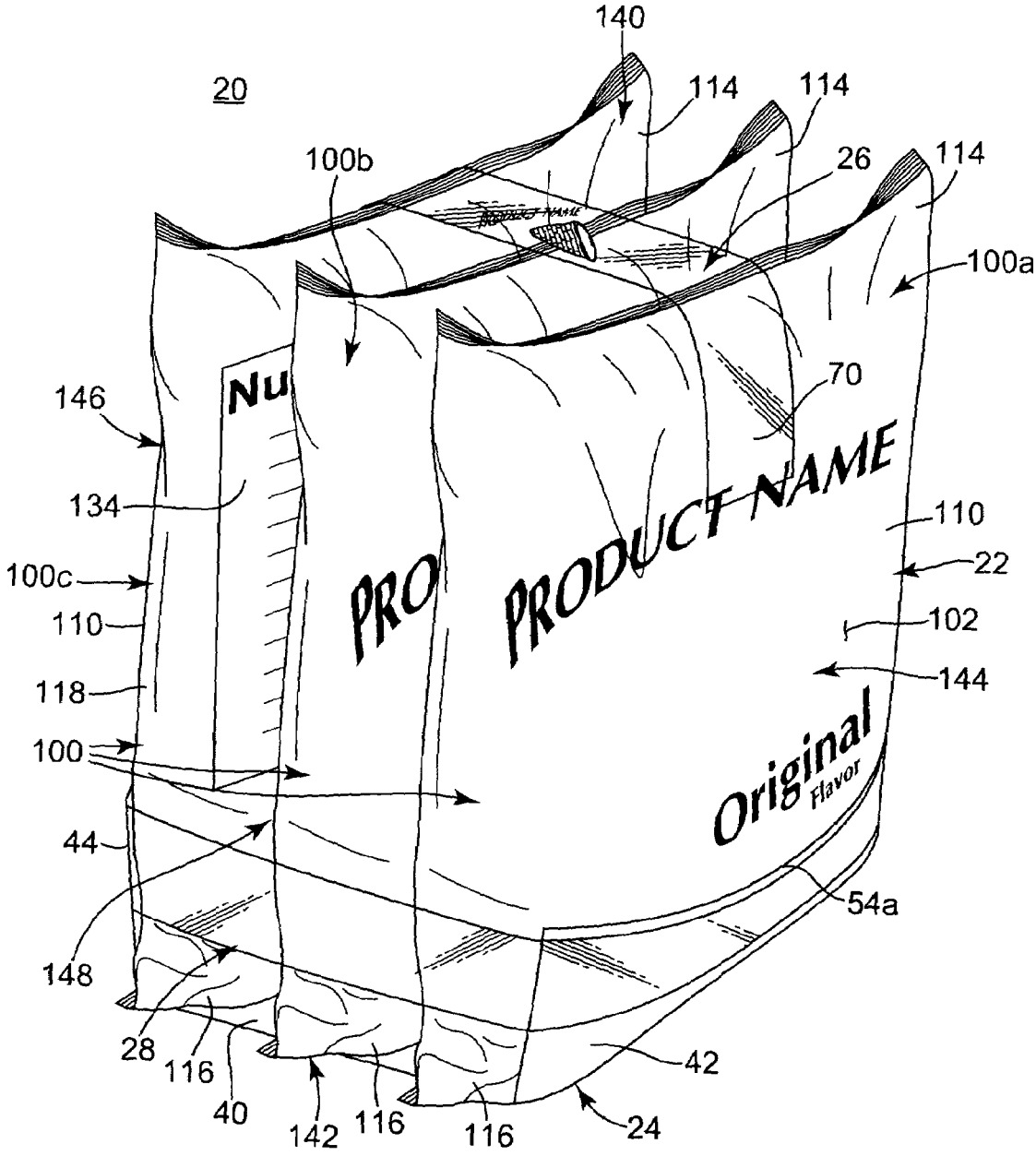
FIG. 1 is perspective view of a multiple packaged good article package in accordance with the present invention.

One embodiment of a multiple packaged good article package (or "multi-pack package") is shown in FIG. 1. The multi-pack package 20 includes a product array 22, a carrier 24, a handle 26, and retaining means 28. These components are described in greater detail below. In general terms, however, the product array 22 is supported by the carrier 24, with individual components of the product array 22 being secured together via the retaining means 28. The handle 26 extends across a top of the product array 22 and provides a means for carrying the multi-pack package 20.

Figure 2:
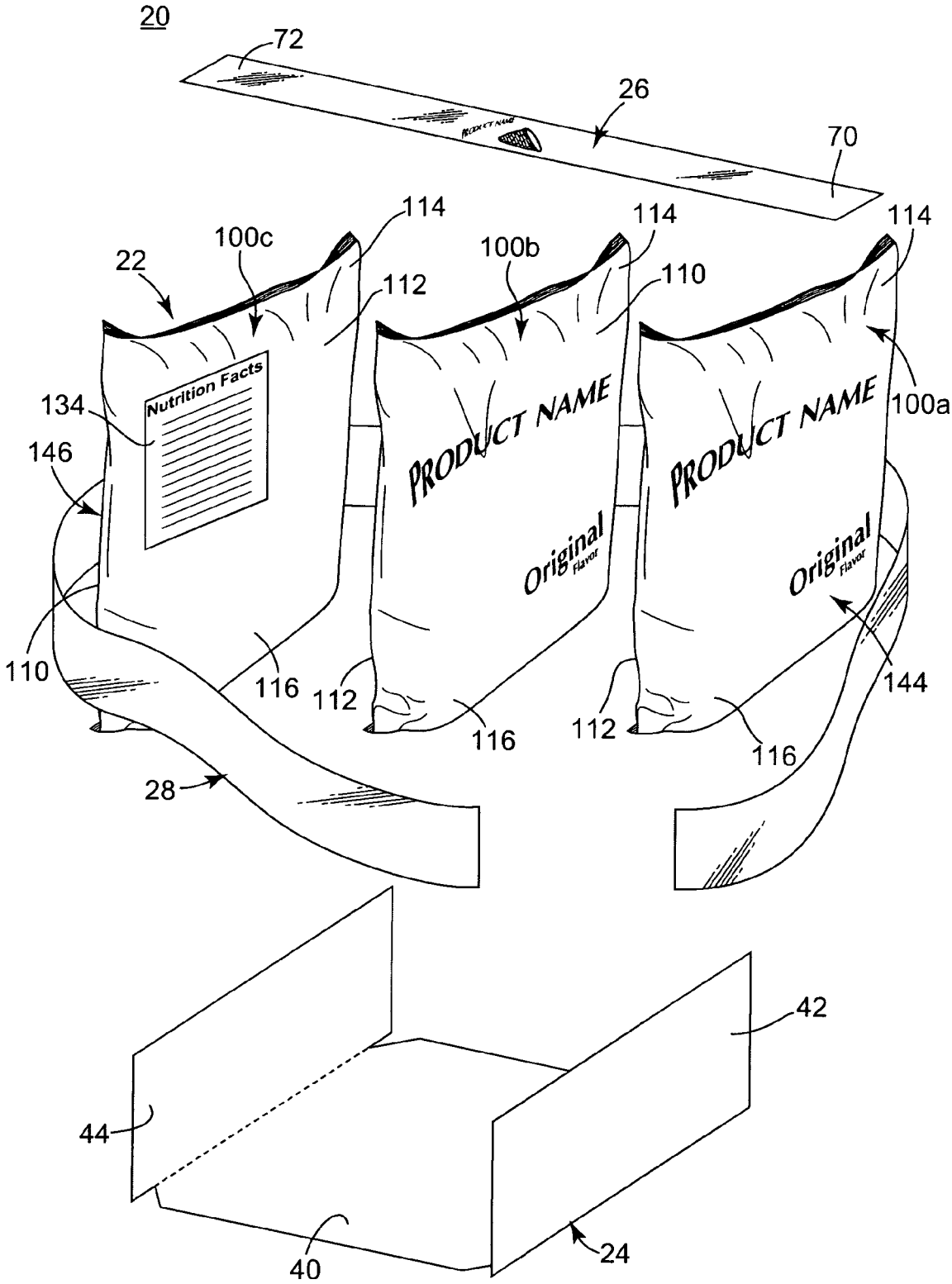
FIG. 2 is an exploded view of the package of FIG. 1.

The carrier 24 is preferably a paper- or paperboard-based component and defines a base panel 40, a first side panel 42, and a second side panel 44 as shown in FIG. 2. The first and second side panels 42, 44 extend in opposing fashion from the base panel 40, and are preferably hingedly connected thereto. More particularly, and with additional reference to FIG. 3, otherwise illustrating a bottom view of the carrier 24 in an unfolded (or "flat") form, a first fold line 46 is formed between the first side panel 42 and the base panel 40, whereas the second fold line 48 is formed between the second side panel 44 and the base panel 40. In a preferred embodiment, each corner 50*a*–50*d* of the base panel 40 defines a cutout region 52*a*–52*d* relative the corresponding side panel 42 or 44. As described in greater detail below, the cutout regions 52*a*–52*d* facilitate desired deflection of portions of the respective first and second side panels 42, 44 relative to the base panel 40 upon final assembly.

In a preferred embodiment, dimensions of the various carrier panels 40–44 are based upon features associated with the product array 22 (FIG. 1). As such, preferred dimensions of the panels 40–44 are described below in conjunction with the product array 22. In general terms, however, the base panel 40 includes opposing exterior edges 54*a*, 54*b*, a distance between which defines a width (W), and opposing interior edges 56*a*, 56*b*, a distance between which defines a length ($L_{BP}$). The width W is selected to accommodate a width of the product array 22, whereas the length $L_{BP}$ is selected to accommodate a length of the product array 22. The side panels 42, 44 are preferably identical, having the same width W as the base panel 40 and a length ($L_{SP}$) that is selected to extend along only a portion of the product array 22. In one embodiment, the width W of the base panel 40 and the side panels 42, 44 is 8 inches (20 cm), the length $L_{BP}$ of the base panel 40 is 8 inches (20 cm), and the length $L_{SP}$ of the side panels 40, 42, is 4 inches±0.5 inch (10 cm±1.3 cm). Further, each of the cutout regions 52*a*–52*d* extend from a point approximately 0.75 inch (1.9 cm) from the corresponding interior edge 56*a* or 56*b* and 0.75 (1.9 cm) inch from the corresponding exterior edge 54*a* or 54*b*. Alternatively, and as made more clear below, a wide variety of other dimensions are equally acceptable, but again are preferably selected as a function of certain characteristics embodied by the product array 22.

Figure 3:
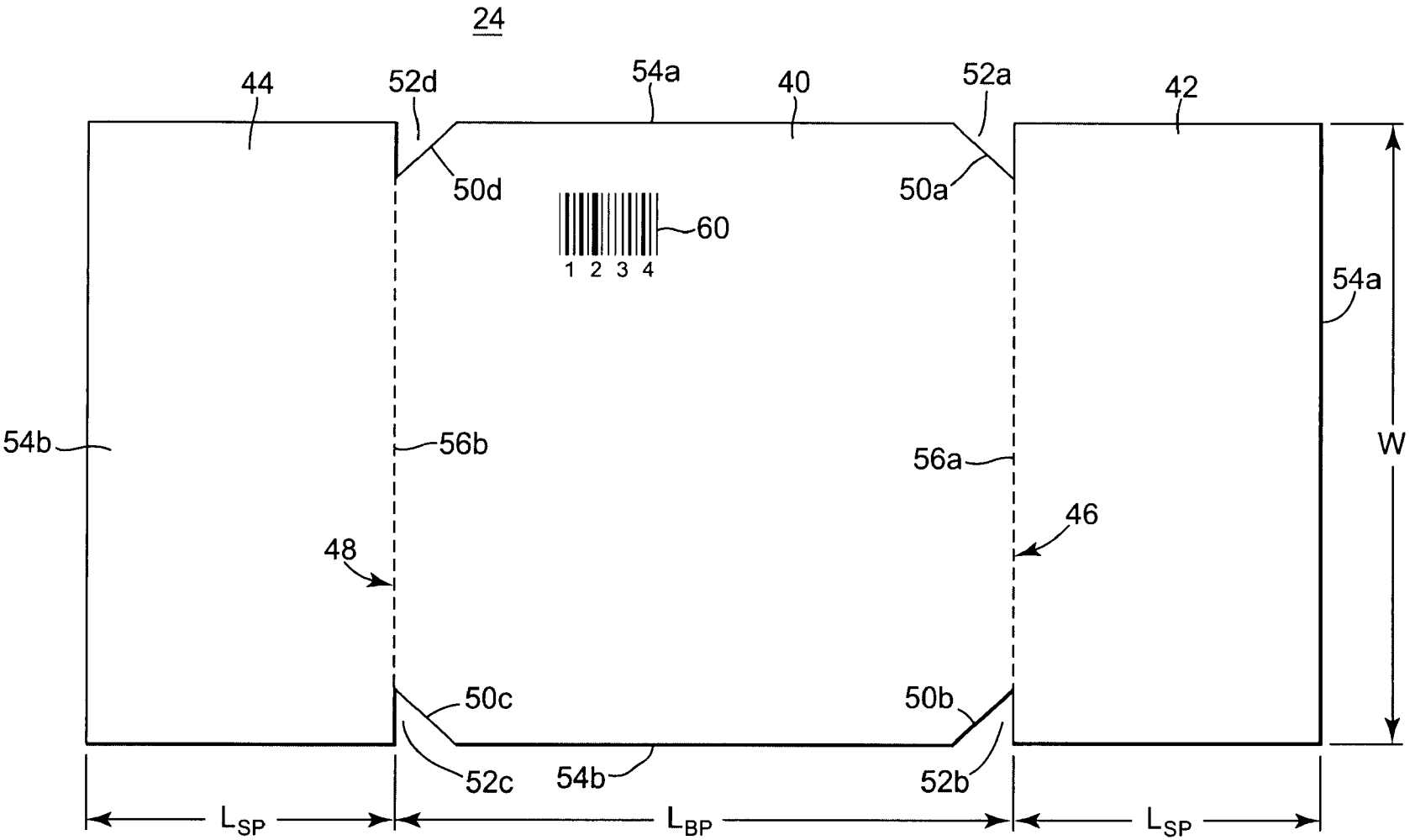
FIG. 3 is a bottom view of a carrier portion of the package of FIG. 1 in a flat state.

As a point of reference, the view of FIG. 3 depicts a backside of the carrier 24 (i.e., the side opposite the product array 22 in the view of FIG. 1). With this in mind, in one embodiment, the carrier 24 includes a bar code symbol 60. As is known in the art, bar code symbols entail a unique number assigned to retail merchandise that identifies both the product and the vendor that sells the product. Normally, the bar code symbol includes a machine-readable bar code along with human-readable numbers and/or letters. Different countries/regions have established different encoding specifications; for example "UPC" symbols are used in the United States, "EAN" symbols are common in Europe and South America, "JAN" forms are common in Japan, etc. As used throughout this specification, the term "bar code symbol" includes any form of optically-scannable point of sale symbol. The bar code symbol 60 provided on the carrier 24 identifies the product array 22 as a whole, and can be placed on the base panel 40 as shown, and/or on either of the side panels 42 or 44. The carrier 24 can further include other indicia, such as nutritional information associated with the product array 22, graphics and/or script, slogans, trademarks, etc.

Figure 4A:
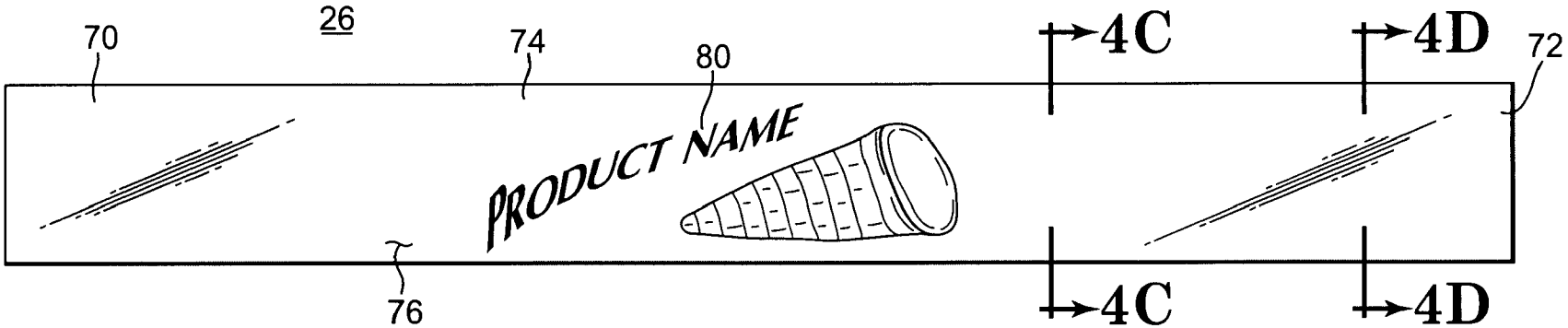
FIG. 4A is a top view of a handle portion of the package of FIG. 1.
Figure 4B:
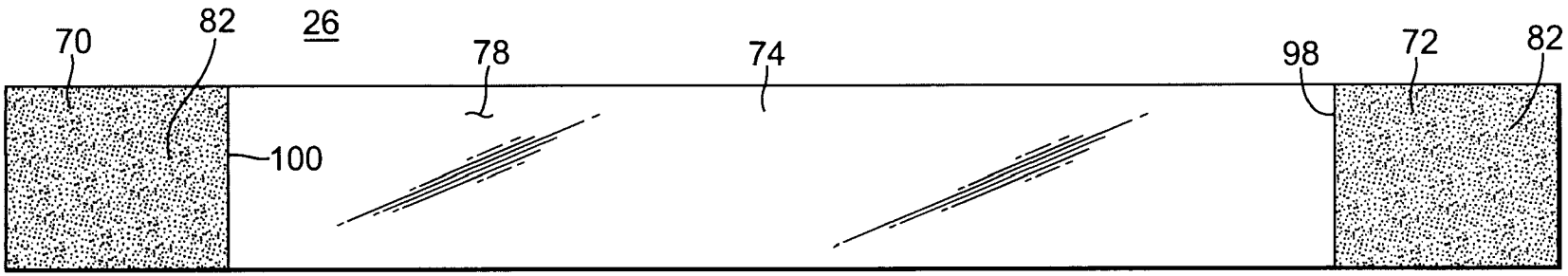
FIG. 4B is a bottom view of the handle of FIG. 4A.

Returning to FIGS. 1 and 2, the handle 26 is preferably an elongated strip adapted to be adhesively secured to other components of the multi-pack package 20. In particular, and with additional reference to FIGS. 4A and 4B, the handle 26 defines opposing end sections 70, 72 and an intermediate section 74. The sections 70, 72, and 74 combine to define an upper surface 76 (shown in FIG. 4A) and a lower surface 78 (shown in FIG. 4B). With these designations in mind, the intermediate section 74 preferably includes indicia 80 at the upper surface 76. The indicia 80 can assume a wide variety of forms, such as printed words, letters, symbols, pictures, etc., as desired, but preferably relates to or describes contents of the multi-pack package 20. The indicia 80 can encompass an entire length of the intermediate section 74, or can be applied to less than an entire length thereof. Regardless, to facilitate assembly of the handle 26 to a remainder of the multi-pack package 20, the end section 70, 72 includes an exposed adhesive 82 at the back surface 78 thereof as best shown in FIG. 4B.

The selected dimensions associated with the handle 26 are a function of the individual components comprising the product array 22, as well as the desired attachment point of the end section 70, 72. For example, in one preferred embodiment where the product array 22 consists of three relatively large (e.g., filled height of at least approximately 6 inches (15 cm)), thin walled, flexible, metallized laminate product-containing bags, and construction of the multi-pack package 20 entails securing of the end section 70, 72 to the product array 22 itself, the handle 26 preferable has a length in the range of 12–15 inches (30.5–38 cm), more preferably 13.5 inches (34.3 cm). Alternatively, and as described in greater detail below, other lengths can also be employed. Regardless, the handle 26 preferably has a width on the order of 1.5–2.5 inches (3.8–6.4 cm), more preferably 2 inches (5 cm).

Figure 4D:
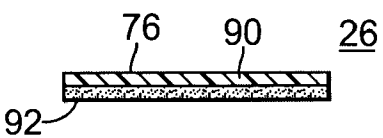
FIG. 4D is a cross-sectional view of the handle of FIG. 4A, taken along the lines 4D—4D.
Figure 4C:
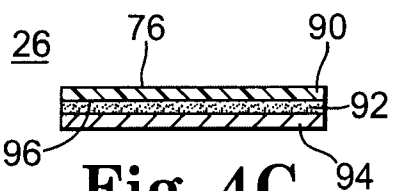
FIG. 4C is a cross-sectional view of the handle of FIG. 4A, taken along the lines 4C—4C.

The handle 26 is preferably transparent except for the indicia 80. As a point of reference, the adhesive 82 is represented by stippling in FIG. 4B for purposes of illustration. It will be understood, however, that the adhesive 82 is preferably transparent as described below. With this in mind, one preferred construction of the handle 26 is shown by the cross-sectional views of FIGS. 4C and 4D. FIG. 4C illustrates the handle 26, and in particular the intermediate section 74, as including a transparent top film layer 90, an adhesive layer 92, and a transparent liner film layer 94. The top film layer 90 is preferably a transparent film, such as biaxially oriented polypropylene (BOPP), and forms the upper surface 76 of the handle 26. Further, the top layer 90 defines a back side 96. In one embodiment, the indicia 80 is printed onto the upper surface 76 of the top layer 90 and is, following printing, UV coated to assist in protecting against scuffing and/or scratching of the printed ink. In one embodiment, the top layer 90 has a thickness of 2 mil (0.05 mm), although other thicknesses are acceptable The adhesive layer 92 is applied to the back side 96 of the top layer 90. The adhesive layer 92 is preferably a transparent, permanent adhesive, such as an emulsion acrylic, available from Fasson Roll North America, of Painesville, Ohio under the trade name "S2001". Alternatively, a wide variety of other known transparent adhesives, including rubber resin adhesives, are also acceptable. Regardless, the adhesive layer 92 is applied to an entirety of the back side 96 of the top layer 90.

Finally, the liner layer 94 is a transparent film selected to be releasably adhered to the adhesive layer 92. For example, in one embodiment, the liner layer 94 is a poly (ethylene terephthalate) (PET) liner film having, in one embodiment, a thickness of approximately 1.5 mil (0.0381 mm). The liner layer 94 covers the adhesive layer 92 along an entirety thereof except at the end section 70, 72 as shown in FIGS. 4B and 4D. For example, during manufacture, slits 98, 100 (FIG. 4B) are formed in the liner layer 94 such that the liner layer 94 can be removed from the end sections 70, 72. Alternatively, other construction techniques can be employed such that the adhesive layer 92 is exposed relative to the top layer 90 at only the end sections 70, 72 (and thus forms the exposed adhesive 82). In one preferred embodiment, the end sections 70, 72, and thus the exposed adhesive 82, has a longitudinal length of approximately 2 inches (5 cm).

Returning to FIG. 1, the retaining means 28 is configured to interconnect individual components of the product array 22. As described in greater detail below, the product array 22 is comprised of a multiplicity of packaged good articles 100. Prior to assembly of the multi-pack package 20, the multiplicity of packaged good articles 100 are independent of one another. The retaining means 28 secures the independent packaged good articles 100 to one another, and, in one preferred embodiment, secures the product array 22 to the carrier 24. With this in mind, in a preferred embodiment, the retaining means 28 is a strip of transparent, hand-force tearable tape (e.g., tape that can readily torn by hand in a cross-width direction) available, for example, from 3M Company, St. Paul, Minn., under the trade name Scotch® Tear-By-Hand Tape 3842-2. With the preferred tearable construction, the tape 28 can be applied to, and extend across, the product array 22, thus interconnecting the individual packaged good articles 100. When desired, the tape 28 can be easily hand torn by a user in a cross-width direction. Alternatively, other tape structures can be employed. Even further, and as described in greater detail below, the retaining means 28 can assume a wide variety of other forms.

As previously described, the product array 22 consists of a multiplicity of packaged good articles 100. In one embodiment, three of the packaged good articles 100 are provided. Alternatively, any number greater than three is also acceptable. Each of the packaged good articles 100 includes an outer package 102 that contains a product (not shown). The outer package 102 can assume a wide variety of forms, and essentially encompasses any known packaging technique. For example, with the embodiment of FIGS. 1 and 2, the outer package 102 of each of the packaged good articles 100 is a thin-walled, flexible, metallized laminate bag conventionally used as packaging for snack-type consumable products such as snack chips, pretzels, crackers, etc. Alternatively, the outer package 102 can be a thin-walled film or plastic (transparent or opaque), paperboard-based, foil, rigid plastic, metal (e.g., aluminum), glass, etc. Further, in addition to the bag configuration illustrated in FIGS. 1 and 2, the outer package 102 can be a pouch, box, carton, canister, bottle, etc.

Similarly, the contained product associated with each of the packaged good articles 100 can also assume a wide variety of forms. Essentially, the contained product is any type of product conventionally sold to consumers in packaged form, and thus can be, for example, snack food items, such as chips, pretzels, popcorn (popped or un-popped), crackers; cereal-based products (e.g., formed from wheat, oats, rice, etc.) including ready-to-eat cereals, such as puffs, flakes, shreds, and combinations thereof (and can include other ingredients such as dried fruits, nuts, dried marshmallows, sugar coatings, etc.); other dried food products such as dried pasta (e.g., spaghetti noodles, rice, beams, etc.); liquid products (with varying degrees of viscosity) such as water, soda pop, juice, yogurt, etc.; consumable products for animals such as bird seed, dog food, etc.; non-consumable products such as fertilizer pellets, plant or vegetable seeds, de-icing salt pellets, etc.); etc. In this regard, while each of the packaged good articles 100 are of a substantially similar configuration in terms of an overall size and shape of the outer package 102, the contained product may vary in one form or another between individual ones of the packaged good articles 100. For ease of explanation, the product array 22 can be described as including first, second, and third packaged good articles 100*a*–100*c* (it being recalled that the product array 22 can include more than three of the packaged good articles 100). Each of the packaged good articles 100*a*–100*c* can include virtually identical products. Alternatively, one of the packaged good articles 100*a*, 100*b*, or 100*c* can contain a product that is slightly different from the other packaged good articles 100*a*–100*c* in terms of one or more characteristics such as ingredients, size, shape, color, texture, flavoring, etc. Thus, the first and second packaged good articles 100*a*, 100*b* can include a snack food item having a first flavor, whereas the third packaged good article 100*c* can include a snack food product having a second flavor. A number of different combinations can be provided with the product array 22. Where the multi-pack package 20 is marketed as a bulk-type product unit for which consumers expect to receive a cost savings for purchasing relatively large quantities, it has surprisingly been found that increased sale can be achieved by providing at least one of the packaged good articles 100*a*–100*c* with a product that differs at least slightly from products associated with others of the packaged good articles 100*a*–100*c*.

While the packaged good articles 100 comprising the product array 22 can assume a wide variety of forms, the multi-pack package 20 of the present invention is particularly useful with existing, relatively large packaged good articles 100, the outer package 102 of which does not readily provide a high degree of structural stability. For example, snack food items are commonly packaged and sold in individual, relatively large bags (i.e., bags sized to contain multiple servings of the snack food product such as bags having a filled volume in the range of at least 216 $cm^3$, more preferably a filled volume in the range of 1700–9200 $cm^3$ and/or a height of at least 6 inches (15 cm), more preferably in the range of 6–20 inches (15–51 cm), even more preferably at least 10 inches (25.4 cm), and even more preferably at least 15 inches (38 cm)) made of a flexible, metallized laminate (e.g., 15 ounce (425 g) and 48 ounce (1.4 kg) bags of Chex-Mix® snack foods, and 12.25 ounce (347 g) and 24 ounce (680 g) bags of Bugles® snack foods, it being understood that these are but a few products useful as the packaged good article 100; a multitude of other products and other packagings, sold under entirely different trade names (or no trade name at all) are equally useful). As previously described, existing packaging techniques cannot group multiple ones of these relatively large, flexible, metallized laminate bags in a consumer- and retailer-acceptable form. While it may be possible to design a new, more rigid outer package for these snack food products to replace the flexible, metallized laminate bag (e.g., a rigid box that replaces the bag) that would otherwise facilitate a compact grouping of similar products as part of a multi-pack package, this change in outer packaging is not economically viable on a mass production basis as entirely new packaging equipment would be required. The present invention overcomes this concern by providing a packaging technique that incorporates the packaged good article in its existing form. That is to say, the packaging of the present invention is adaptable to the outer package 102 of the packaged good articles 100 in its existing form, and does not require that the outer package 102 be altered.

Figure 5A:
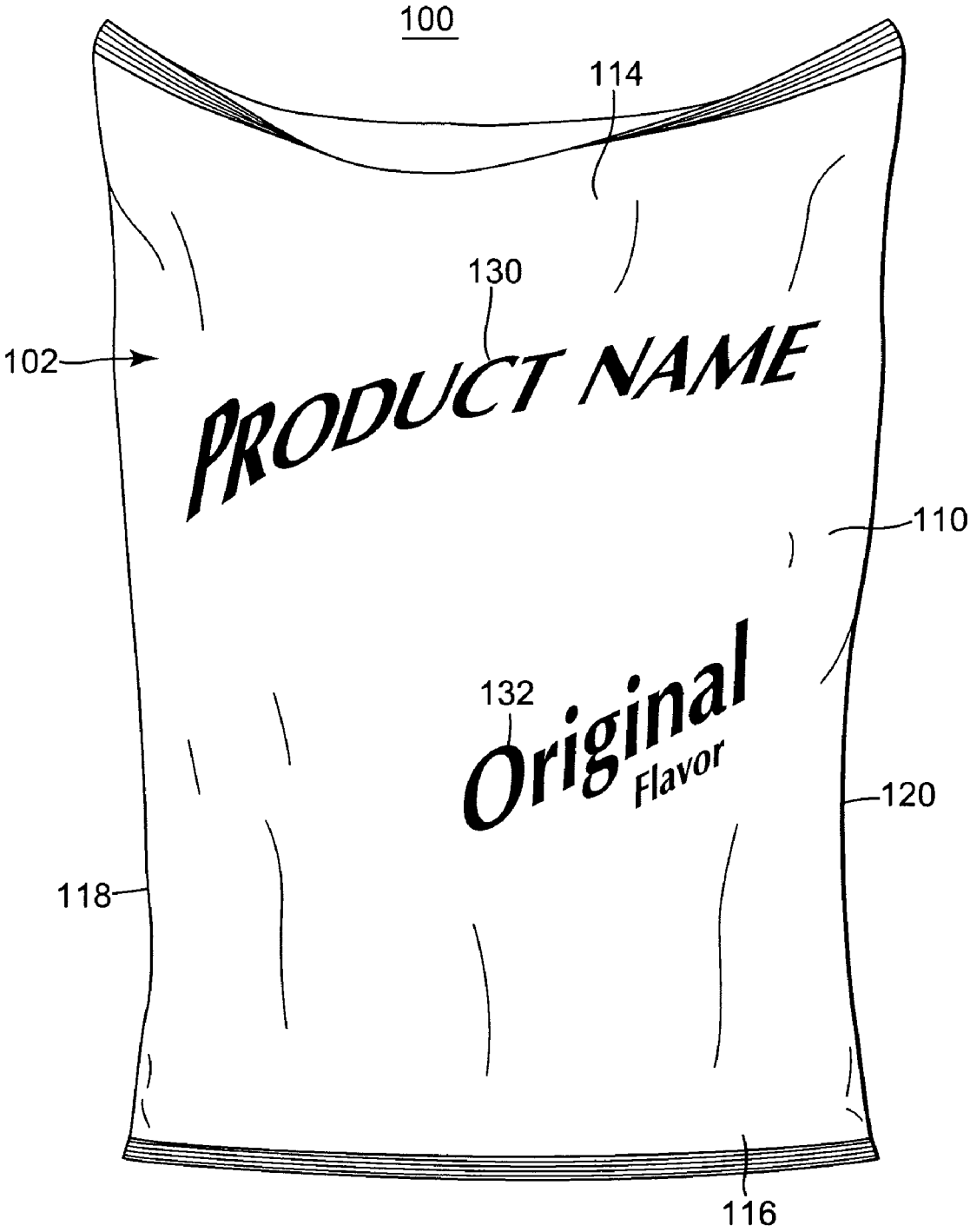
FIG. 5A is a front view of an exemplary packaged good article useful with the package of FIG. 1.
Figure 5B:
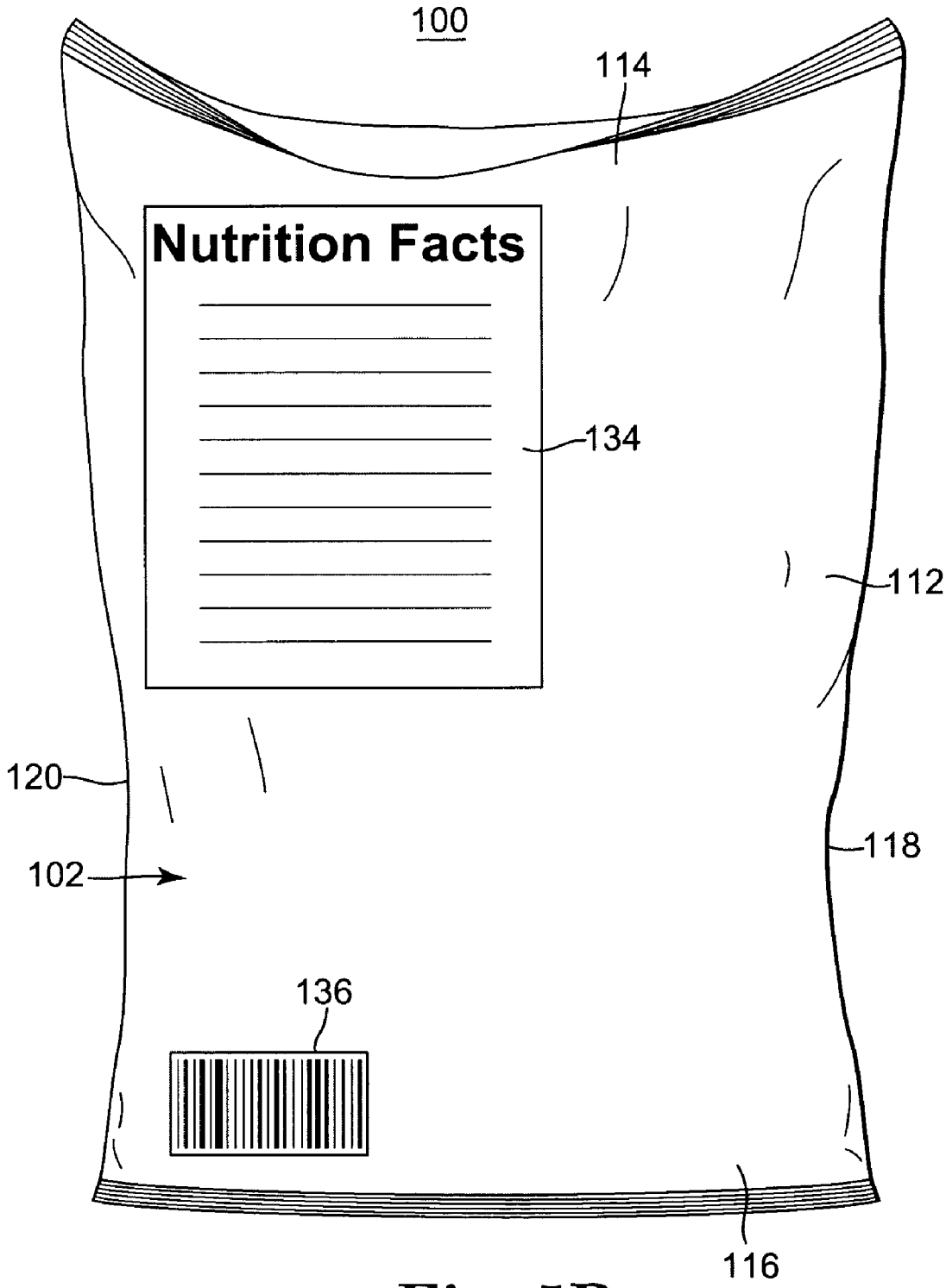
FIG. 5B is a rear view of the packaged good article of FIG. 5A.

With the above in mind, preferred assembly of the product array 22 is a function of the individual packaged good articles 100, including indicia provided on the respective outer packages 102 thereof. With additional reference to FIGS. 5A and SB (otherwise depicting a front and back, respectively, of an exemplary packaged good article 100), the outer package 102 defines a front major face 110 (FIG. 5A), a back major face 112 (FIG. 5B), a top region 114, a bottom region 116, and opposing sides 118, 120 (one of which is shown in FIG. 1; referenced generally in FIGS. 5A and 5B). The major faces 110, 112 are connected to one another along the top and bottom regions 114, 116, as well as the opposing sides 118, 120. Pursuant to conventional merchandising techniques, indicia is provided on both the front and back major faces 110, 112 that clearly identifies the respective face as either the front or the back of the package 102. For example, the front major face 110 includes primary indicia 130 that prominently displays the trade name and/or trademark assigned to the contained product. Conventionally, the primary indicia 130 is of a much larger type face size as compared to any other wording appearing on the outer package 102. In addition, the front major face 110 includes secondary indicia 132 designating a secondary characteristic of the contained product of interest to a consumer. For example, the secondary indicia 132 can designate a flavor characteristic of the contained product. Other conventional secondary information provided on the front major face 110 as the secondary indicia 132 can relate to texture, color, etc. Regardless, the secondary indicia 132 is typically in a relatively large type face size, and manufacturers consider it important that the consumer be able to view the secondary indicia 132 so as to make an informed purchasing decision.

The back major face 112 also includes indicia 134 (referenced generally in FIG. 5B) that may or may not repeat the primary indicia 130 and/or the secondary indicia 132 provided on the front major face 110. Regardless, the indicia 134 associated with the back major face 112 is of a smaller type face as compared to the primary and secondary indicia 130, 132 of the front major face 110, and typically includes a multitude of additional information such as ingredients, nutritional information, reference to related products, etc. In addition, the back major face 112 displays a bar code symbol 136. The bar code symbol 136 is typically provided at the bottom region 116 of the back major face 112.

With the above in mind, and with specific reference to FIG. 2, the product array 22 is formed by arranging the multiplicity of packaged good articles 100 in a major face-to-major face fashion. For example, the front major face 110 of the second packaged good article 100*b* is placed against the back major face 112 (referenced generally in FIG. 2) of the first packaged good article 100*a*. The third packaged good article 100*c* can be similarly positioned. In one embodiment, however, where the first and third packaged good articles 100*a*, 100*c* define outermost packages of the product array 22, the third packaged good article 100*c* is arranged such that the front major face (referenced generally in FIG. 2) thereof faces outwardly (i.e., the back major face 112 of the third packaged good article 100*c* lies against the back major face 112 (referenced generally in FIG. 2) of the second packaged good article 100*b*). Once again, the product array 22 can consist of more than three of the packaged good articles 100. Regardless, and as shown in FIG. 1, the resultant product array 22 defines a top 140, a bottom 142, a front 144, a back 146 (referenced generally in FIG. 1), and opposing sides 148, 150 (one of which is shown in FIG. 1).

With the one embodiment of FIGS. 1 and 2, the packaged good articles 100 comprising the product array 22 are arranged in an upright fashion such that the individual top regions 114 combine to define the top 140 of the product array 22, whereas the bottom regions 116 combine to define the bottom 142. The front major face 110 of the first packaged good article 100*a* defines the front 144 of the product array 22, whereas the front major face 110 (referenced generally of FIGS. 1 and 2) of the third packaged good article 100*c* defines the back 146 (referenced generally of FIGS. 1 and 2) of the product array 22. Alternatively, and as described in greater detail below, the product array 22 can be rotated relative to the orientation shown in FIGS. 1 and 2 such that the front major face 110 of the first packaged good article 100*a* defines the bottom 142 of the product array 22, and the combined top regions 114 define the front 144 of the product array 22.

Regardless, the product array 22 is then assembled to the carrier 24. In particular, the bottom 142 of the product array 22 is placed on the base panel 40 of the carrier 24 such that the front 144 is adjacent the first side panel 42 and the back 146 is adjacent the second side panel 44. The first side panel 42 is folded upwardly relative to the base panel 40 and the product array 22 such that the first side panel 42 extends along a portion of the front 144 of the product array 22. Similarly, the second side panel 44 is folded relative to the base panel 40 and the product array 22 such that the second side panel 44 extends along a portion of the back 146 of the product array 22. With respect to the one preferred product array 22 of FIG. 1, the first side panel 42 extends along a portion of the front major face 110 of the first packaged good article 100*a*, whereas the second side panel 44 extends along a portion of the front major face 110 of the third packaged good article 100*c*.

The retaining means 28, which as previously described is preferably a length of tape, is wrapped about at least a portion of the product array 22 and the carrier 24. In particular, and in one embodiment, the tape 28 is adhered to and extends from the first side panel 42 to the second side panel 44, contacting the side 148 of the product array 22, and in particular the side 118 of each of the respective packaged good articles 100*a*–100*c*. With this configuration, the tape 28 connects each of the packaged good articles 100*a*–100*c* to one another, as well as secures the carrier 24 to the product array 22. In a more preferred embodiment, the tape 28 is wrapped about an entirety of the product array 22 such that both sides 148, 150 (one of which is shown in FIGS. 1 and 2) are adhered to the tape 28. In alternative embodiments, the tape 28 can be wrapped several times about the carrier 24 and the product array 22. Regardless, the tape 28 is preferably positioned as close as possible to the top edge 54*a*, 54*b* of the first and second side panels 42, 44, respectively.

The handle 26 is then secured so as to extend across the top 140 of the product array 22. In one preferred embodiment, the first end section 70 of the handle 26 is adhered to the front 144 of the product array 22 (or the front major face 110 of the first packaged good article 100*a*), whereas the second end section 72 of the handle 26 is adhered to the back 146 of the product array (or the front major face 110 of the third packaged good article 100*c*). Thus, the handle 26 extends across the top region 114 of each of the packaged good articles 100, providing a convenient surface for handling of the multi-pack package 20.

Figure 6A:
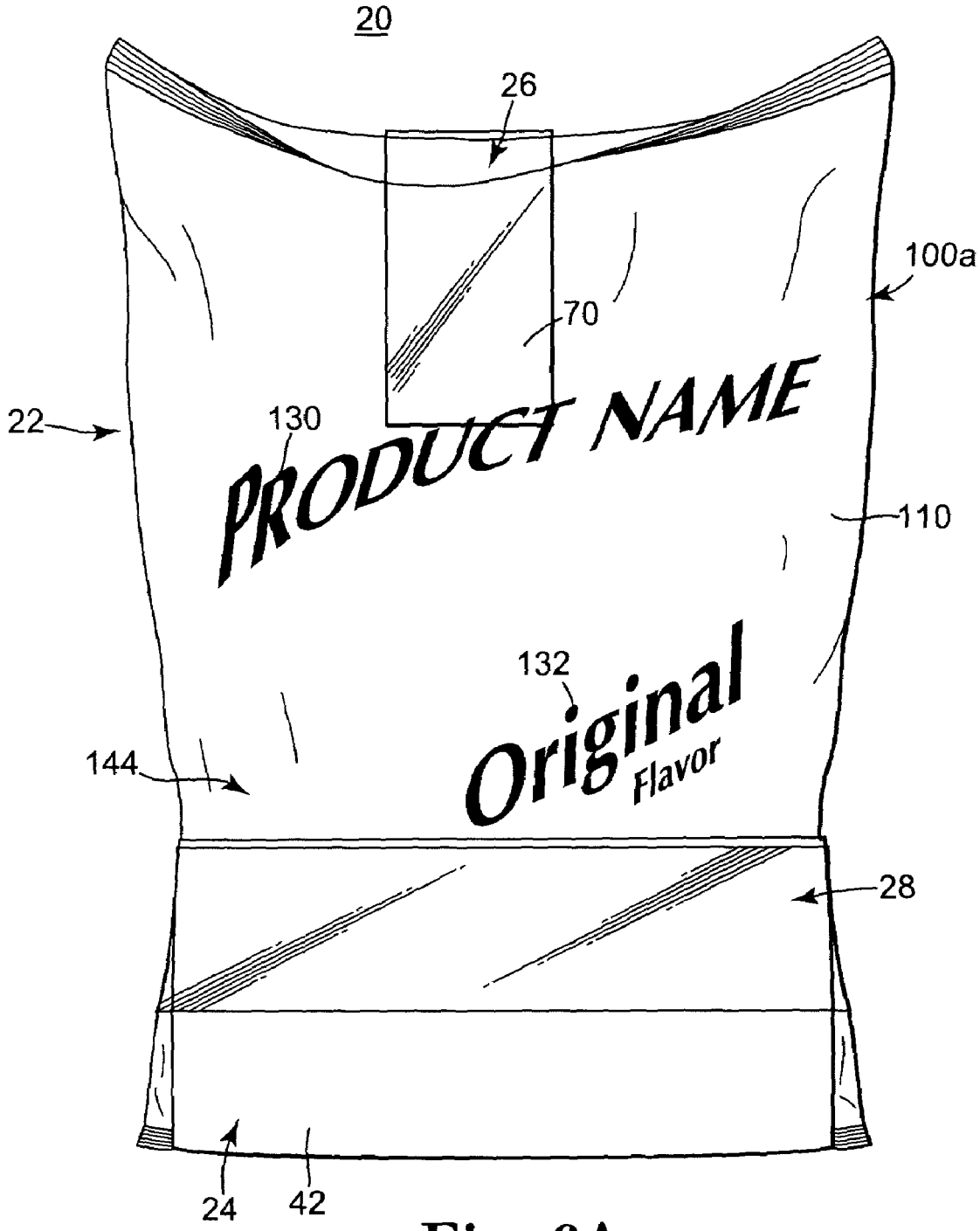
FIG. 6A is a front view of the package of FIG. 1.

The so-assembled multi-pack package 20 provides a number of highly preferred features best explained with reference to FIGS. 1, 6A, and 6B. The side panels 42 and 44 associated with the carrier 24 are preferably sized in accordance with features associated with the packaged good articles 100*a*–100*c*. In particular, FIG. 6A illustrates a position of the first side panel 42 relative to the front major face 110 of the first packaged good article 100*a*(and thus of the front 144 of the product array 22). As previously described, one embodiment of the front major face 110 includes the primary indicia 130 and the secondary indicia 132. In order to best encourage a customer's understanding of the contents of the multi-pack package 20, and thus make a positive purchasing decision, it is desirable that the secondary indicia 132 not be entirely obscured by the side panel 42. Conventionally, the secondary indicia 132 is disposed within a lower third of the front major face 110. Thus, the carrier 24 is preferably constructed such that upon folding of the side panel 42 relative to the base panel 40 (hidden in FIG. 6A), the side panel 42 does not extend beyond a location of the secondary indicia 132. Though not shown in FIG. 6A, the relationship of the second side panel 44 relative to the front major face 110 of the third packaged good article 100*c* (FIG. 2) is preferably identical. Additionally, the first end section 70 of the handle 26 is shown as being applied to the front major face 110 of the first packaged good article 100*a*. Due to the preferred transparent nature of the handle 26 at the end sections 70, 72 (it being noted that only the end section 70 is shown in FIG. 6A), the handle 26 does not unnecessarily cover or otherwise obscure viewing of the front 144 or the back 146 (FIG. 2) of the product array 22. For example, with the configuration of FIG. 6A, the front major face 110 of the first packaged good article 100*a* can include highly stylized graphics that have otherwise been selected to be noticed by a potential consumer and entice purchasing thereof. Thus, by not overtly obscuring the front major face 110, the desired appearance of the packaged good article 100*a*, and thus of the product array 22, is maintained.

Figure 6B:
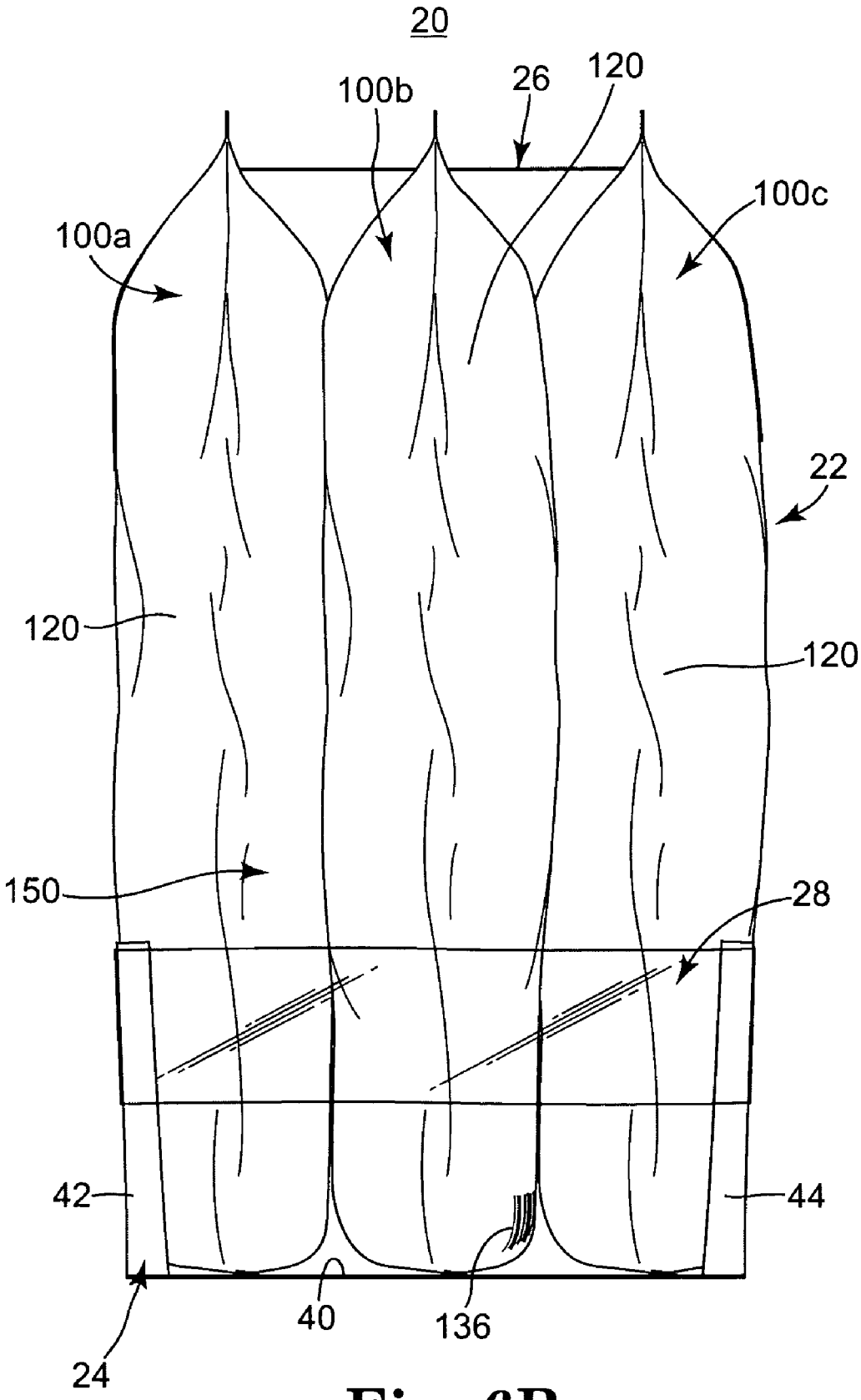
FIG. 6B is a side view of the package of FIG. 1.

As best shown in FIG. 6B, upon final assembly, the side panels 42, 44 are able to slightly wrap about the sides 148, 150 (it being noted that only the side 150 is shown in FIG. 6B) of the product array 22, and thus the sides 118, 120 (only the sides 120 are shown in FIG. 6B) of the respective packaged good articles 100*a*–100*c*. The previously described cutout regions 52*a*–52*d* (FIG. 3) facilitate this preferred wrapping relationship. As a result, the multi-pack package 20 has a neat, aesthetically pleasing appearance. In one embodiment, the side panels 42, 44 are constructed such that the sides 148, 150 of the product array 22 (and thus, with the one embodiment of FIG. 6B, the sides 118, 120 of the respective packaged good articles 100*a*–100*c*) can be viewed by a consumer so as to enhance the consumer's confidence in the content of the multi-pack package 20. To this end, and as previously described, with the one preferred embodiment in which the retaining means 28 is a strip of transparent tape, the retaining means 28 does not obscure the consumer's view of the product array sides 148, 150. Alternatively, however, the carrier 24 can be constructed such that additional side panels are provided that otherwise extend along at least a portion of the product array sides 148, 150. For example, the carrier 24 can include retaining panels extending from the side panels 42, 44 that are otherwise configured to interlock with one another upon final assembly, thus serving as the retaining means 28 (and replacing the tearable tape component associated with the one embodiment described).

Regardless, the carrier 24 is configured so as to at least partially obscure the bar code symbol 136 (shown partially in FIG. 6B for the second package good article 100*b*, it being understood that the bar code symbol 136 associated with the first packaged good article 100*a* is not shown in FIG. 6B for ease of illustration and the bar code symbol 136 associated with the third packaged good article 100*c* is located adjacent a side opposite the side shown in FIG. 6B) associated with each of the packaged good articles 100*a*–100*c*. For example, with the product array 22 arrangement and orientation relative to the carrier 24 of FIG. 6B, the bar code symbol 136 for each packaged good article 100*a*–100*c* is located adjacent the base panel 40 of the carrier 24. In this regard, the base panel 40 at least partially obscures each of the bar codes symbol 136 such that during a purchasing transaction, a store clerk will not accidentally scan the bar code symbol 136 associated with an individual one of the packaged good articles 100*a*–100*c* (that might otherwise indicate a product price for a single packaged good article as opposed to the multi-pack package 20). Further, and in accordance with one embodiment, the carrier 24 displays the bar code symbol 60 FIG. 3) that otherwise corresponds with a desired price of the multi-pack package 20.

During use, a retailer can readily display two or more of the multi-pack packages 20 on a single shelf due to the relatively rigid, compact form thereof. Subsequently, a consumer (not shown) is readily able to transport the multi-pack package 20 by simply grasping the handle 26 and lifting. Notably, in addition to supporting each of the packaged good articles 100*a*–100*c* relative to one another, the retaining means 28 prevents intentional or unintentional displacement of one of the packaged good articles 100*a*–100*c* relative to the others. For example, the retaining means 28 prevents the second package good article 100*b* from being removed from the multi-pack package 20 prior to purchase via securement of the second packaged good article 100*b* to the first and third packaged good articles 100*a*, 100*c*. Once purchased, however, the retaining means 28, and in particular, the one preferred embodiment in which the retaining means 28 is a tearable tape, the consumer (not shown) can readily tear the tape 28 so as to access the individual packaged good articles 100*a*–100*c* without requiring use of a scissors or other sharp instrument that might otherwise damage one or more of the packaged good articles 100*a*–100*c* and/or harm the user.

Figure 7A:
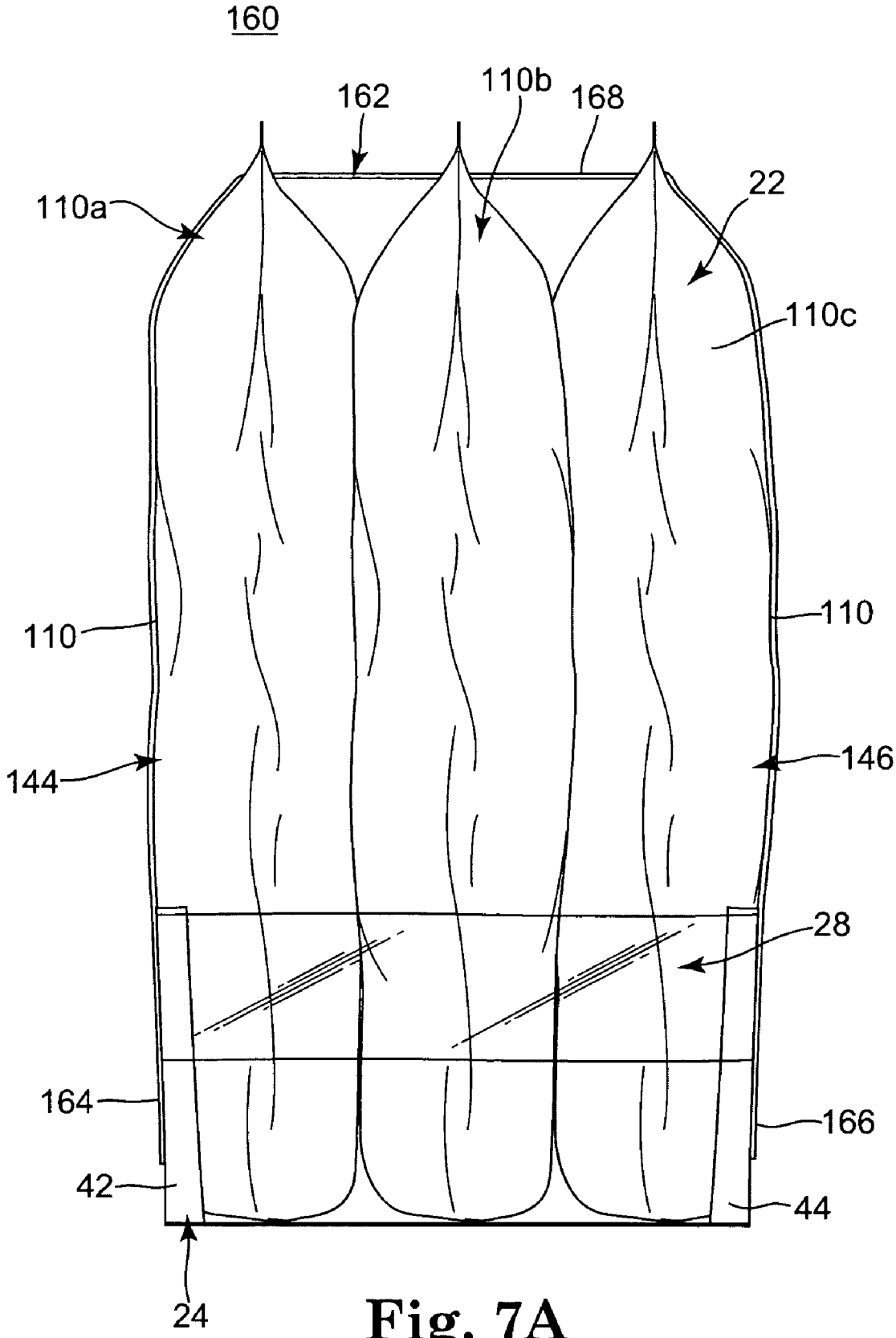
FIG. 7A is a side view of an alternative packaged good article package in accordance with the present invention.
Figure 7B:
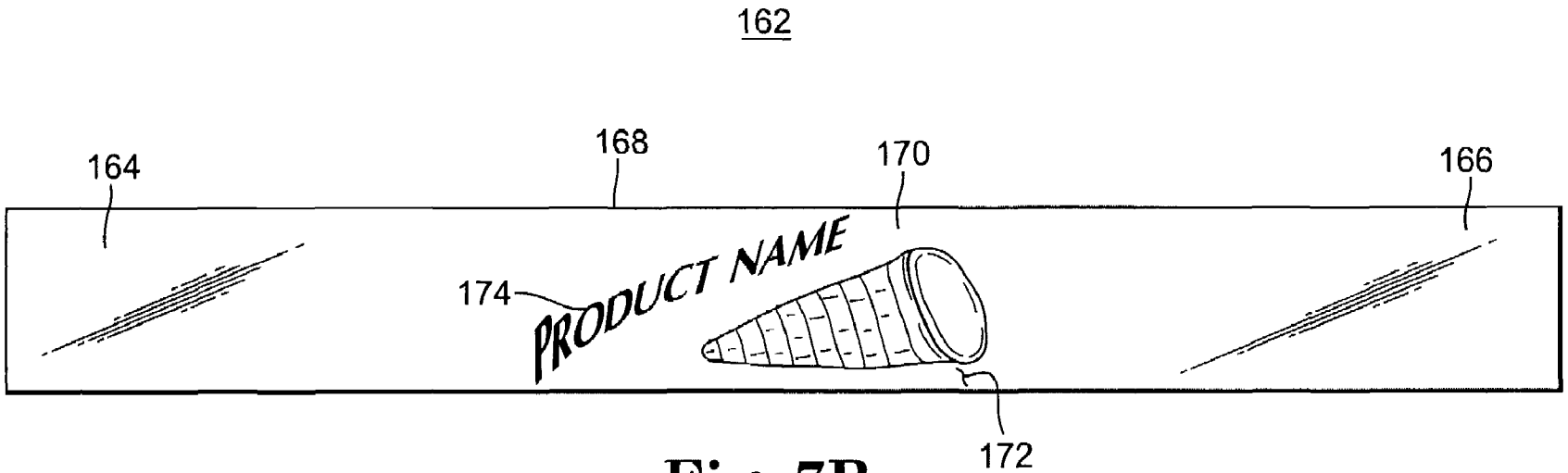
FIG. 7B is a top view of a handle portion of the package of FIG. 7A.

Several of the above-described components can be altered and remain within the scope of the present invention. For example, FIG. 7A illustrates an alternative embodiment multi-pack package 160 highly similar to the multi-pack package 20 previously described. In particular, the multi-pack package 160 includes the product array 22, the carrier 24, and the retaining means 28. In addition, the multi-pack package 160 provides a handle 162 that varies slightly from the handle 26 (FIG. 1) previously described. The handle 162 is again an elongated strip defining first and second end sections 164, 166 and an intermediate section 168. For ease of illustration, a thickness of the handle 162 is greatly exaggerated in the view of FIG. 7A. With additional reference to FIG. 7B, otherwise illustrating a top view of the handle 162 prior to assembly to the multi-pack package 160, the intermediate section 168 further defines a central region 170, a top surface 172 of which includes indicia 174. As with the handle 26 (FIG. 1) previously described, a bottom surface (hidden in FIG. 7B) of the handle 162 includes exposed adhesive at the first and second end sections 164, 166. Notably, other than the indicia 174, the handle 162 is transparent. With the embodiment of FIG. 7A and 7B, the handle 162 is sized to extend from the first side panel 42 to the second side panel 44, and thus is longer than the handle 26 previously described. In one embodiment, in which the product array 22 consists of three 12.25-ounce flexible, metallized laminate bags of snack food products, the handle 162 has a length of approximately 25.5 inches (65 cm), each of the end sections 164, 166 has a length of approximately 2 inches (5 cm), and the central region 170 has a length of approximately 9.5 inches (24 cm). With this configuration, and upon final assembly, the first end section 164 is adhesively secured to the first side panel 42, whereas the second end section 166 is adhesively secured to the second side panel 44. The central region 170 extends over the top 140 of the product array 22, with remaining portions of the handle 162 being transparent. The preferred transparent nature of the handle 162 does not overtly impede viewing of graphics or other indicia provided on the front 144 and the back 146 of the product array 22 (and thus the front major face 110 of the first packaged good article 100*a* and the front major face 110 of the third packaged good article 100*c*). Once again, the handle 162 preferably has a width of approximately 2 inches (5 cm) to provide sufficient surface area for grasping by a consumer.

Figure 8A:
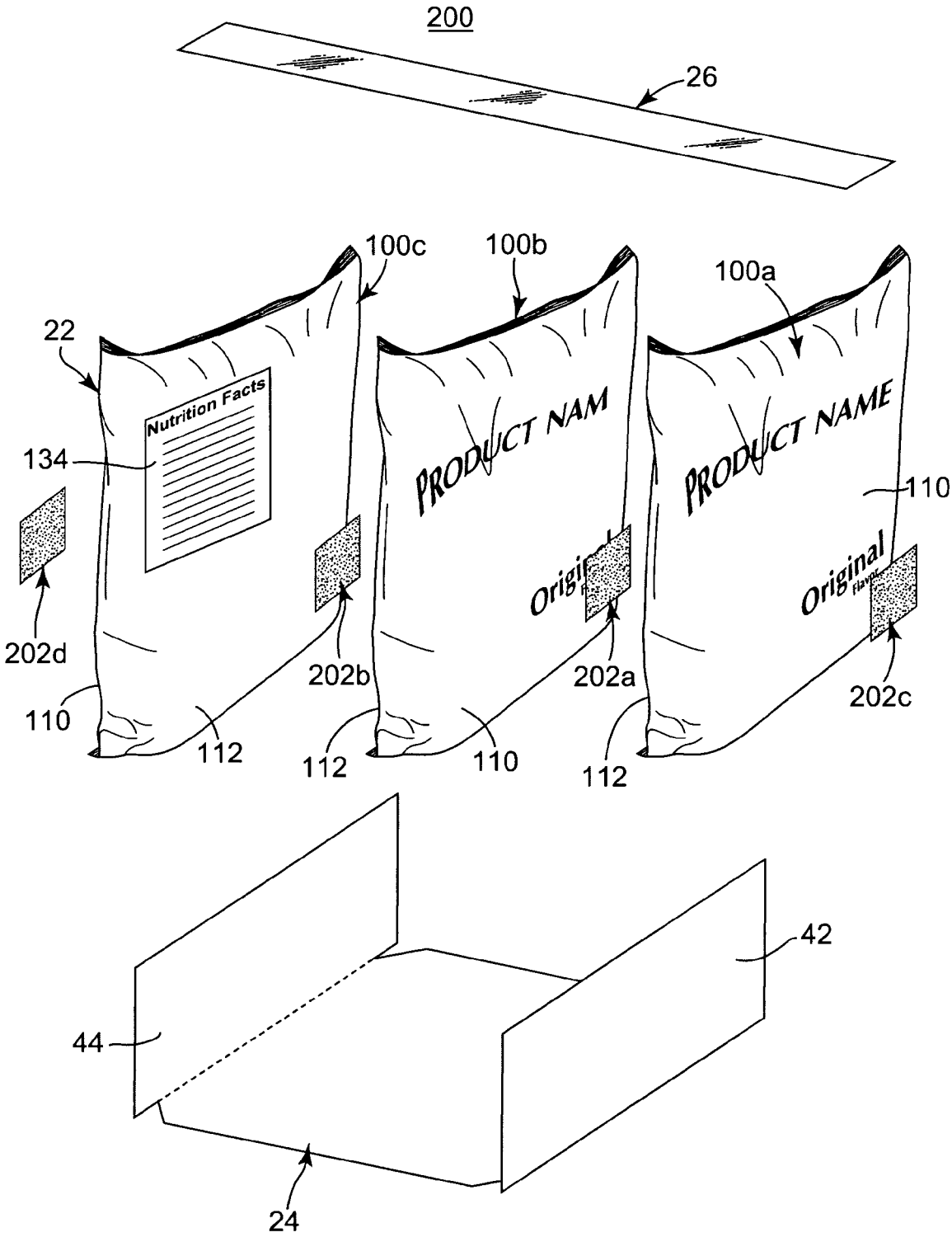
FIG. 8A is an exploded view of another embodiment multiple packaged good article package in accordance with the present invention.
Figure 8B:
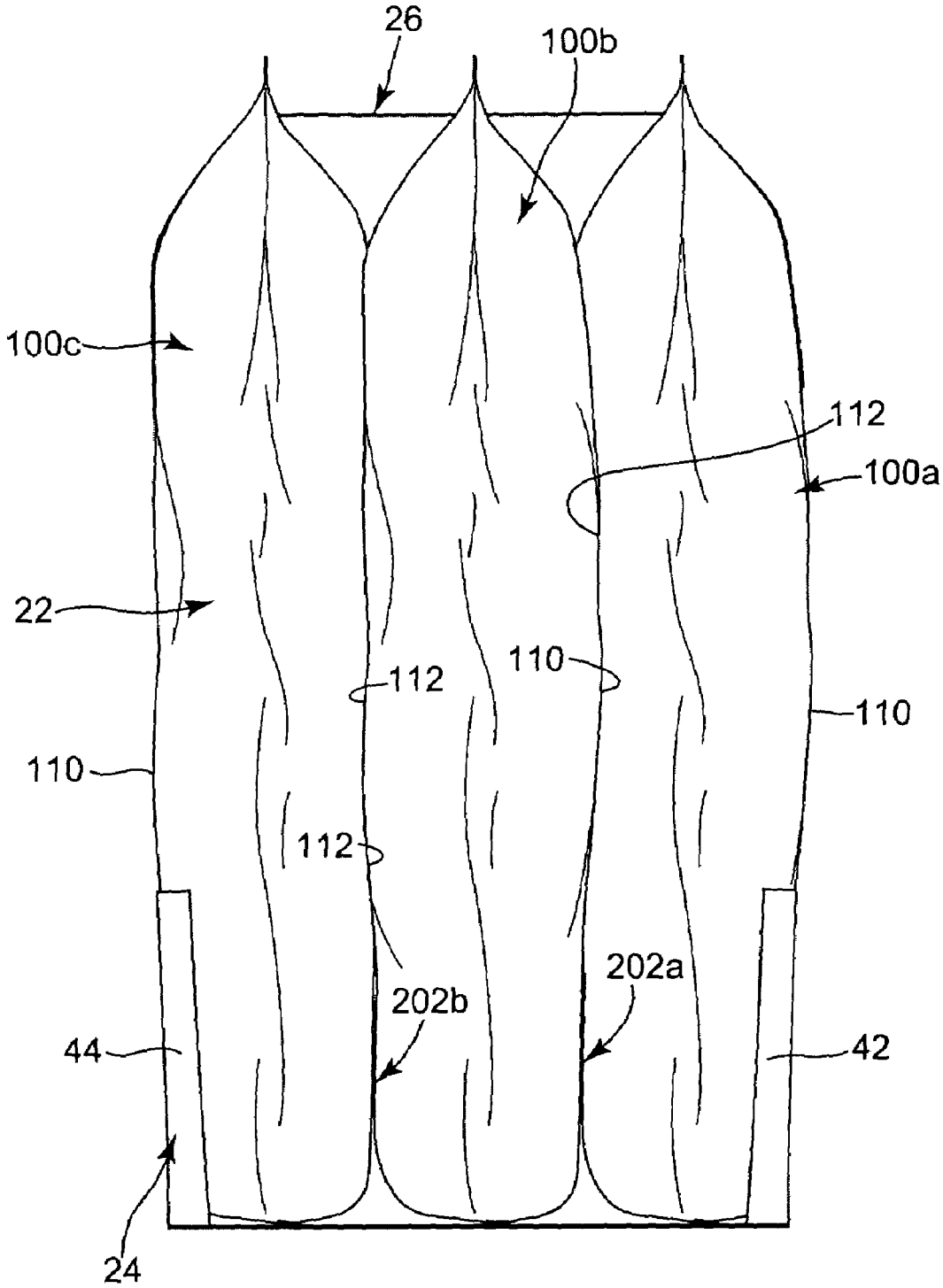
FIG. 8B is a side view of the package of FIG. 8A upon final assembly.

Yet another alternative embodiment multi-pack package 200 in accordance with the present invention in shown in FIGS. 8A and 8B. Similar to previous embodiments, the multi-pack package 200 includes the product array 22, the carrier 24, and the handle 26. In addition, the multi-pack package 200 includes a retaining means 202 (referenced generally as 202*a*–202*d* in FIG. 8A) that varies from previous embodiments. In particular, with the embodiment of FIGS. 8A and 8B, the retaining means 202 includes one or more adhesive components sized and positioned to secure adjacent ones of the packaged good articles 100*a*–100*c* to one another, as well as to secure the first packaged good article 100*a* to the first side panel 42 and the third packaged good article 100*c* to the second side panel 44.

In one preferred embodiment, the adhesive components 202 are small strips of double-sided tape. Alternatively, a glue or other liquid adhesive can be applied. Regardless, and by way of reference, the adhesive components 202 includes a first adhesive component 202*a* that secures the back major face 112 of the first packaged good article 100*a* to the front major face 110 of the second packaged good article 100*b*. Similarly, a second adhesive component 202*b* secures the back major face 112 (referenced generally in FIGS. 8A and 8B) of the second packaged good article 100*b* to the back major face 112 of the third packaged good article 100*c*. A third adhesive component 202*c* secures the front major face 110 (referenced generally in FIGS. 8A and 8B) of the first packaged good article 100*a* to the first side panel 42, and a fourth adhesive component 202*d* secures the front major face 110 of the third packaged good article 100*c* to the second side panel 44. Notably, two or more individual adhesive components can be employed to secure adjacent packaged good articles 100 to one another and/or one or both of the first or third packaged good articles 100*a*, 100*c* to the first or second side panel 42, 44, respectively.

Upon final assembly, and as best shown in FIG. 8B, the adhesive components 202 (FIG. 8A) are positioned at an interior of the product array 22, and as such are not readily viewable by a consumer. Nonetheless, the adhesive components 202 prevent unintended displacement of one of the packaged good articles 100*a*–100*c* relative to the others, as well as secure the product array 22 to the carrier 24.

Figure 9:
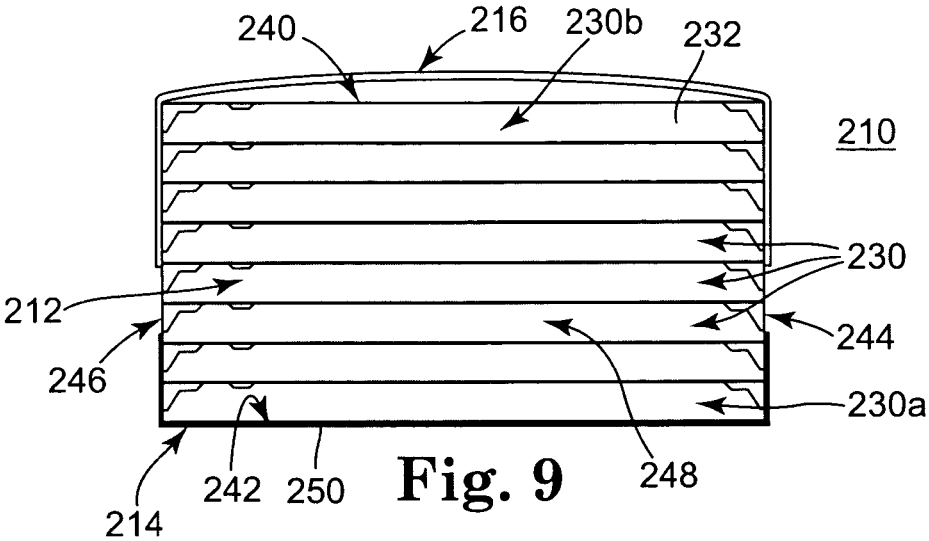
FIG. 9 is a side view of an alternative multiple packaged good article package in accordance with the present invention.
Figure 10:
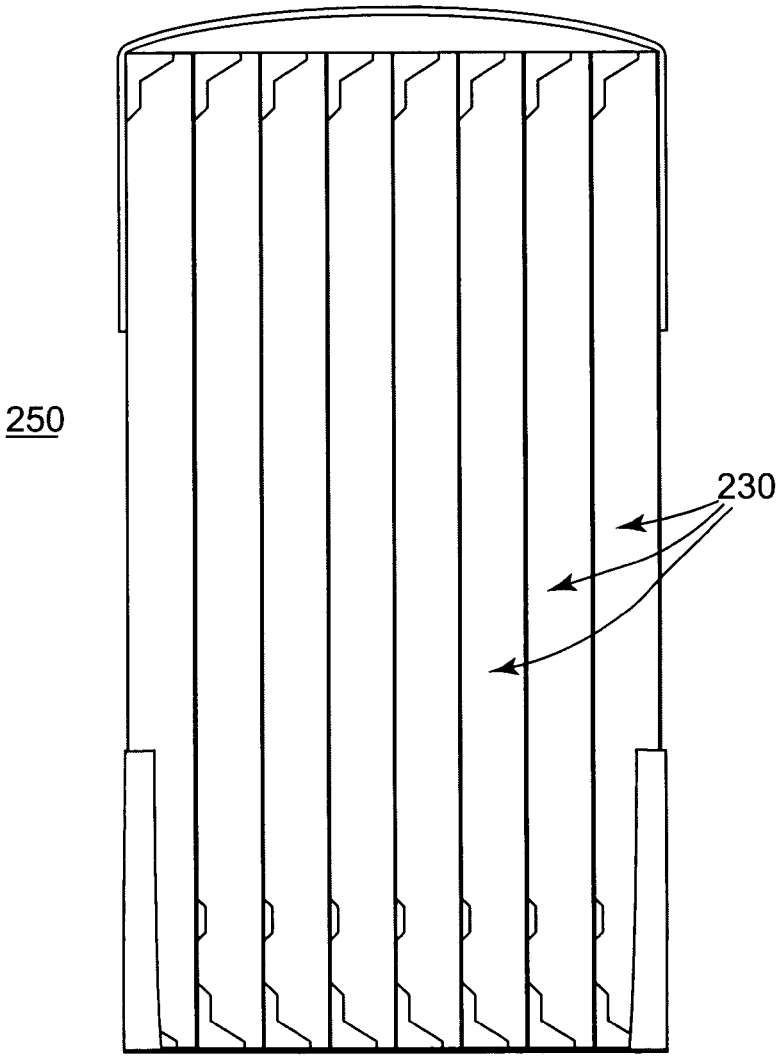
FIG. 10 is a side view of an alternative multiple packaged good article package in accordance with the present invention.

While embodiments of the present invention have been described with respect to packaged good articles including flexible, metallized laminate bags assembled in an upright fashion, a wide variety of other product array configurations can be employed. For example, FIG. 9 illustrates another alternative embodiment, multi-pack package 210 that includes a product array 212, a carrier 214, a handle 216, and retaining means (hidden in the view of FIG. 9). The carrier 214, handle 216, and the retaining means can assume any of the forms previously described. Further, the product array 212, similar to previous embodiments, consists of a multiplicity of packaged good articles 230 (referenced generally in FIG. 9). In particular, with the embodiment of FIG. 9, each of the multiplicity of packaged good articles 230 includes an outer package 232 containing a product (not shown). Each of the outer packages 232 are elongated paperboard boxes and combine to define the product array 212 as having a top 240, a bottom 242, a front 244, a back 246, and opposing sides 248 (one of which is shown in FIG. 9). For example, the multiplicity of packaged good article 230 includes a first package good article 230*a* and a second packaged good articles 230*b*. The packaged good articles 230 are arranged horizontally relative to the carrier 214 such that the first packaged good article 230*a* defines the bottom 242 of the product array 212, and thus rest on a base panel 250 of the carrier 214. Conversely, the second package good article 230*b* defines the top 240 of the product array 212. With this configuration, the handle 216 extends across the top 240 of the product array 212, with the retaining means (again, hidden in the view of FIG. 9) serving to interconnect adjacent ones of the packaged good article 230. FIG. 10 illustrates yet another embodiment multi-pack package 250 similar to the multi-pack package 210 (FIG. 9) previously described, except that the plurality of packaged good articles 230 are arranged horizontally.

Although the present invention has been described with reference to preferred embodiments, skilled in the art will recognize that the changes can be made in form and detail without departing from the spirit and scope of the present invention.

What is claimed is:

1. A multiple packaged good article package comprising:

a carrier including a base panel and first and second side panels extending from opposite sides of the base panel;

a multiplicity of packaged good articles each including a flexible walled bag defining opposing major faces, a top region, and a bottom region;

wherein the multiplicity of packaged good articles are arranged on the carrier in an upright, major face-to-major face fashion so as to define first and second outermost packaged good articles, each having an exposed major face relative to a remainder of the packaged good articles, and an interior packaged good article, and further wherein each of the bottom regions contact the base panel and the first and second side panels extend along a portion of the exposed major face of the first and second outermost packaged good articles, respectively;

a handle provided apart from the carrier and extending across the top regions of the packaged good articles, from the exposed major face of the first outermost packaged good article to the exposed major face of the second outermost packaged good article, wherein the handle is an elongated strip defining opposing first and second end sections, and further including:

a trans parent top film layer;

an adhesive layer disposed along a back side of the top film layer; and a transparent liner film layer adhered to the adhesive layer opposite the top film layer, the liner film layer having a length less than a length of the top film layer such that the adhesive layer is exposed at the first and second end sections; and retaining means for securing the interior packaged good article to the outermost packaged good articles.

2. The package of claim 1, wherein the side panels are hingedly secured to the base panel.

3. The package of claim 1, wherein the carrier is formed of paperboard.

4. The package of claim 1, wherein the opposing major faces of each of the multiplicity of packaged good articles includes a front face and a back face, the front face defining an upper portion adjacent the top region and a lower portion adjacent the lower region, the upper portion including primary indicia designating a trade name of contained product and the lower portion including secondary indicia designating a characteristic of the contained product, and further wherein upon final assembly, the front face of the first outermost packaged good article is the exposed face and the first side panel does not cover the secondary indicia of a first outermost packaged good article.

5. The package of claim 4, wherein the secondary indicia describes a flavor of the contained product.

6. The package of claim 4, wherein upon final assembly, the front face of the second outermost packaged good article is the exposed face and the second side panel does not cover the secondary indicia of the second outermost packaged good article.

7. The package of claim 6, wherein the first and second side panels have a height of approximately 4 inches.

8. The package of claim 1, wherein the bag of each of the multiplicity of packaged good articles displays a bar code symbol, and further wherein upon final assembly, at least a portion of each of the bar code symbols is obscured.

9. The package of claim 8, wherein upon final assembly, the carrier covers at least a portion of at least one of the bar code symbols.

10. The package of claim 9, wherein the base panel includes an interior surface against which the multiplicity of packaged good articles rest and an exterior surface, the exterior surface including a bar code symbol designating information relating to the multiple packaged good article package.

11. The package of claim 1, wherein a product flavor of the first outermost packaged good article is different from a product flavor of a second outermost packaged good article.

12. The package of claim 1, wherein the elongated strip is configured such that upon final assembly, the first end section is adhered to the exposed major face of the first outermost packaged good article via the adhesive layer and the second end section is adhered to the exposed major face of the second outermost packaged good article via the adhesive layer.

13. The package of claim 1, wherein the elongated strip is characterized as being transparent at the first and second end sections.

14. The package of claim 13, wherein the elongated strip further defines an intermediate section between the first and second end sections, at least a portion of the intermediate section including indicia.

15. The package of claim 14, wherein the elongated strip is characterized by the absence of paper.

16. The package of claim 14, wherein the indicia is printed on a front side of the top film layer.

17. The package of claim 1, wherein the elongated strip has a width of approximately 2 inches.

18. The package of claim 1, wherein the bag of each of the multiplicity of packaged good articles further defines opposing side regions extending between the opposing major faces such that upon final assembly, the opposing side regions extend in a generally perpendicular fashion relative to the base panel, and further wherein, the retaining means includes a tape strip adhered to, and extending between, the opposing side panels such that the tape strip extends across at least one of the opposing side regions of each of the packaged good articles.

19. The package of claim 18, wherein the tape strip is adhesively secured to at least one of the side regions of each of the packaged good articles.

20. The package of claim 18, wherein the tape strip is transparent.

21. The package of claim 18, wherein the tape strip is a tearable tape strip.

22. The package of claim 18, wherein the tape strip includes a first section extending across a first side region of each of the packaged good articles and a second section extending across a second side section of each of the packaged good articles.

23. The package of claim 1, wherein the retaining means includes an adhesive element securing major faces of adjacent packaged good articles to one another.

24. The package of claim 23, wherein the adhesive element is glue.

25. The package of claim 23, wherein the adhesive element is double-sided tape.

26. The package of claim 23, wherein the retaining means includes a plurality of adhesive elements separately securing major faces of adjacent pairs of packaged good articles to one another, respectively.

27. The package of claim 1, wherein the bag of each of the multiplicity of packaged good articles has a filled height of at least 6 inches.

28. A multiple packaged good article package comprising:

a multiplicity of packaged good articles arranged in a major face-to-major face fashion so as to define a product array, the product array defining a top, a bottom, a front, a back, and opposing sides;

a carrier including a base panel and first and second side panels extending from opposite sides of the base panel;

wherein the bottom of the product array is positioned on the base panel, the first side panel extends along a portion of the front of the product array, and the second side panel extends along a portion of the back of the product array;

a handle provided apart from the carrier and extending across the top of the product array, from the front of the product array to the back of the product array, wherein the handle is an elongated strip defining opposing first and second end sections, and further including:

a top film layer;

an adhesive layer disposed along a back side of the top film layer; and a liner film layer adhered to the adhesive layer opposite the top film layer, the liner film layer having a length less than a length of the top film layer such that the adhesive layer is exposed at the first and second end sections; and retaining means for securing a first one of the packaged good articles to an adjacent, second one of the packaged good articles.

29. The package of claim 28, wherein the retaining means includes at least one component apart from the carrier and handle.

30. The package of claim 28, wherein the multiplicity of packaged good articles each include a similarly formed package selected from the group consisting of a flexible bag, a rigid pouch, a box, a canister, a can, and a bottle.

31. The package of claim 30, wherein upon final assembly, adjacent ones of the multiplicity of packaged good articles contact one another.

32. The package of claim 31, wherein each of the packaged good articles includes opposing major faces, a top and a bottom, and further wherein, upon final assembly, the bottoms of the packaged good articles abut the base panel.

33. The package of claim 31, wherein upon final assembly, a major face of one of the multiplicity of packaged good articles abuts the base panel.

34. The package of claim 30, wherein each of the packaged good articles includes an outer package having a filled volume of at least 216 $cm^3$.

35. The package of claim 30, wherein each of the multiplicity of packaged good articles includes an outer package having a height of at least 6 inches.

36. The package of claim 28, wherein the carrier is paperboard-based and the handle is plastic-based.

37. The package of claim 28, wherein each of the multiplicity of packaged good articles includes opposing front and back major faces, the front major face defining an upper portion including primary indicia designating a trade name of contained product and a lower portion including secondary indicia designating a characteristic of the contained product, and further wherein upon final assembly, the front major face of the first packaged good article forms the front of the product array and the first side panel does not cover the secondary indicia of the first packaged good article.

38. The package of claim 37, wherein the secondary indicia describes a flavor of the contained product.

39. The package of claim 37, wherein the back of the product array is formed by the front major face of a third packaged good article, and the second side panel does not cover the secondary indicia of the third packaged good article.

40. The package of claim 28, wherein each of the multiplicity of packaged good articles includes an outer package displaying a bar code symbol, and further wherein upon final assembly, at least a portion of each of the bar code symbols is obscured.

41. The package of claim 40, wherein upon final assembly, the base panel obscures at least a portion of each of the bar code symbols.

42. The package of claim 28, wherein the base panel includes an interior surface and an exterior surface, the exterior surface including a bar code symbol providing information relating to the multiple packaged good article package.

43. The package of claim 28, wherein the elongated strip is configured such that upon final assembly, the first end section is adhered to the front of the product array via the adhesive layer, and the second end section is adhered to the back of the product array via the adhesive layer.

44. The package of claim 28, wherein the retaining means includes a tape strip adhered to and extending between the first and second side panels such that the tape strip extends across at least one of the opposing sides of the product array.

45. The package of claim 44, wherein the tape strip is transparent.

46. The package of claim 28, wherein the retaining means includes an adhesive element securing major faces of adjacent packaged good articles to one another.

47. The package of claim 46, wherein the adhesive element is double-sided tape.

48. A method of assembling a multiple packaged good article package, the method comprising:

providing a carrier including a base panel and first and second side panels extending from opposite sides of the base panel;

arranging a multiplicity of packaged good articles in a major face-to-major face fashion to define a product array defining a top, a bottom, a front, a back, and opposing sides;

placing the bottom of the product array on the base panel;

positioning the side panels relative to the base panel such that the first side panel extends along a portion of the front of the product array and the second side panel extends along a portion of the back of the product array;

securing adjacent ones of the multiplicity of packaged good articles to one another; and extending a handle from the front of the product array to the back of the product array across the top of the product array, wherein the handle is provided apart from the carrier, wherein the handle is an elongated strip defining opposing first and second sections, and further including:

a top thin layer;

an adhesive layer disposed along a back side of the top film layer; and a liner film layer adhered to the adhesive layer opposite the top film layer, the liner film layer having a length less than a length of the top film layer such that the adhesive layer is exposed at the first and second end sections.

49. The method of claim 48, wherein each of the multiplicity of packaged good articles includes an outer package defining major faces, a top region, and a bottom region, and further wherein the bottom of the product array is defined by a combination of the respective bottom regions.

50. The method of claim 49, wherein the outer package of each of the multiplicity of packaged good articles is a flexible bag.

51. The method of claim 48, wherein each of the multiplicity of packaged good articles includes an outer package defining opposing major faces, a top region, and a bottom region, and further wherein the bottom of the product array is defined by a major face of one of the packages.

52. The method of claim 48, wherein each of the multiplicity of packaged good articles includes an outer package defining front and back opposing major faces, a top region, and a bottom region, the front major face including primary indicia designating a trade name of contained product and secondary indicia designating a characteristic of the contained product, and further wherein the front of the product array is formed by the front major face of a first packaged good article, and further wherein positioning the first side panel includes ensuring that the first side panel does not cover the secondary indicia of the first packaged good article.

53. The method of claim 52, wherein the primary indicia is formed in an upper half of the front major face and the secondary indicia is formed in a lower half of the front major face.

54. The method of claim 52, wherein the secondary indicia describes a flavor of the contained product.

55. The method of claim 52, wherein the back of the product array is formed by the front major face of a second packaged good article, and further wherein positioning the second side panel includes ensuring that the second side panel does not cover the secondary indicia of the second packaged good article.

56. The method of claim 48, wherein the multiplicity of packaged good articles each include an outer package displaying a bar code symbol, the method further comprising:

obscuring at least a portion of the bar code symbols.

57. The method of claim 56, wherein placing the bottom of the product array on the base panel results in the base panel obscuring at least a portion of the bar code symbol of at least one of the packaged good articles.

58. The method of claim 48, wherein securing adjacent packaged good articles includes extending an adhesive tape along one of the opposing sides of the product array such that the adhesive tape adheres to and connects adjacent ones of the packaged good articles.

59. The method of claim 48, wherein securing adjacent packaged good articles includes adhesively securing a major face of a first packaged good article to a major face of a second packaged good article adjacent the first packaged good article.

60. The method of claim 59, wherein adhesively securing major faces of the first and second packaged good articles includes connecting the major face of the first packaged good article to the major face of the second packaged good article with a double-side tape.

61. The method of claim 48, wherein the handle is an elongated strip defining opposing first and second end sections each having an exposed adhesive coating, and further wherein extending a handle includes:

adhering the first end section to the front of the product array; and adhering the second end section to the back of the product array.

62. The method of claim 61, wherein the front of the product array is formed by a major face of a first packaged good article and the back of the product array is formed by a major face of a second packaged good article.

63. A multiple packaged good article package comprising:

a carrier including a base panel and first and second side panels extending from opposite sides of the base panel;

a multiplicity of packaged good articles each including a flexible walled bag defining opposing major faces, a top region, and a bottom region;

wherein the multiplicity of packaged good articles are arranged on the carrier in an upright, major face-to-major face fashion so as to define first and second outermost packaged good articles, each having an exposed major face relative to a remainder of the packaged good articles, and an interior packaged good article, and further wherein each of the bottom regions contact the base panel and the first and second side panels extend along a portion of the exposed major face of the first and second outermost packaged good articles, respectively;

a handle provided apart from the carrier and extending across the top regions of the packaged good articles, from the exposed major face of the first outermost packaged good article to the exposed major face of the second outermost packaged good article, wherein the handle is an elongated strip defining opposing first and second end sections, an exterior of which is coated with an adhesive, and further wherein the elongated strip is configured such that upon final assembly, the first end section is adhered to the first side panel via the coated adhesive, and the second end section is adhered to the second side panel via the coated adhesive; and retaining means for securing the interior packaged good article to the outermost packaged good articles.

64. A multiple packaged good article package comprising:

a multiplicity of packaged good articles arranged in a major face-to-major face fashion so as to define a product array, the product array defining a top, a bottom, a front, a back, and opposing sides;

a carrier including a base panel and first and second side panels extending from opposite sides of the base panel;

wherein the bottom of the product array is positioned on the base panel, the first side panel extends along a portion of the front of the product array, and the second side panel extends along a portion of the back of the product array;

a handle provided apart from the carrier and extending across the top of the product array, from the front of the product array to the back of the product array, wherein the handle is an elongated strip defining opposing first and second end sections, an exterior of each of which is coated with adhesive, and further wherein the elongated strip is configured such that upon final assembly, the first end section is adhered to the first side panel via the coated adhesive, and the second end section is adhered to the second side panel via the coated adhesive; and retaining means for securing a first one of the packaged good articles to an adjacent, second one of the packaged good articles.

65. A method of assembling a multiple packaged good article package, the method comprising:

providing a carrier including a base panel and first and second side panels extending from opposite sides of the base panel;

arranging a multiplicity of packaged good articles in a major face-to-major face fashion to define a product array defining a top, a bottom, a front, a back, and opposing sides;

placing the bottom of the product array on the base panel;

positioning the side panels relative to the base panel such that the first side panel extends along a portion of the front of the product array and the second side panel extends along a portion of the back of the product array;

securing adjacent ones of the multiplicity of packaged good articles to one another; and extending a handle from the front of the product array to the back of the product array across the top of the product array, wherein the handle is an elongated strip defining opposing first and second end sections each having an exposed adhesive coating, the handle provided apart from the carrier, extending the handle including;

adhering the first end section to the first side panel; and adhering the second end section to the second side panel.

* * * * *